US007637047B1

(12) United States Patent
Nielson

(10) Patent No.: US 7,637,047 B1
(45) Date of Patent: Dec. 29, 2009

(54) SUPPORTIVE DISPLAY CONTAINER

(76) Inventor: Kenneth E. Nielson, 574 N. 600 West, Logan, UT (US) 84321

( * ) Notice: Subject to any disclaimer, the term of this patent is extended or adjusted under 35 U.S.C. 154(b) by 18 days.

(21) Appl. No.: 11/752,272

(22) Filed: May 22, 2007

Related U.S. Application Data

(63) Continuation of application No. 09/815,218, filed on Mar. 22, 2001, now Pat. No. 7,234,258.

(51) Int. Cl.
*G09F 3/18* (2006.01)

(52) U.S. Cl. ..... 40/661; 40/606.03; 40/722

(58) Field of Classification Search ..... 40/661, 40/720, 722, 724, 725, 606.03, 324; 220/23.87, 220/23.89; 431/291; 362/447, 101
See application file for complete search history.

(56) References Cited

U.S. PATENT DOCUMENTS

| | | | | | |
|---|---|---|---|---|---|
| 2,001,312 | A | | 5/1935 | O'Connell | 431/126 |
| 2,548,706 | A | | 4/1951 | Corning | 40/10 |
| 2,945,314 | A | * | 7/1960 | Baldwin | 40/324 |
| 3,286,492 | A | | 11/1966 | Frazier | 40/541 |
| 3,374,911 | A | | 3/1968 | White | 215/12.2 |
| 3,561,146 | A | | 2/1971 | Dembar | 40/661 |
| 3,596,391 | A | | 8/1971 | Knight | 40/152 |
| 3,703,045 | A | | 11/1972 | Nyman | 40/152 |
| 3,716,936 | A | | 2/1973 | Miller | 40/152 |
| 3,743,370 | A | | 7/1973 | Lindsay et al. | 312/7.1 |
| 3,774,332 | A | | 11/1973 | Schneider | 40/152.1 |
| 3,990,166 | A | | 11/1976 | Nagelkirk | 200/568 |
| 4,195,729 | A | | 4/1980 | Macken | 206/45.34 |
| 4,240,783 | A | | 12/1980 | Nevin | 431/253 |
| 4,380,292 | A | | 4/1983 | Cramer | 128/919 |
| 4,897,948 | A | | 2/1990 | Owen | 40/661 |
| 4,928,412 | A | * | 5/1990 | Nishiyama | 40/324 |
| 4,930,235 | A | | 6/1990 | Gillen | 40/661 |
| 4,979,325 | A | | 12/1990 | White | 215/12.2 |
| 5,226,252 | A | | 7/1993 | Haluska | 40/634 |
| 5,511,685 | A | * | 4/1996 | Nelson | 220/662 |
| 5,553,735 | A | * | 9/1996 | Kimura | 362/101 |
| 5,683,239 | A | | 11/1997 | Cardosi | 431/291 |
| 5,894,948 | A | | 4/1999 | Yeh | 215/12.1 |
| 6,012,185 | A | | 1/2000 | Woods | 5/509.1 |
| 6,216,856 | B1 | | 4/2001 | Park | 206/214 |
| 6,256,914 | B1 | * | 7/2001 | Yeh | 40/720 |
| 6,619,811 | B2 | * | 9/2003 | Wang et al. | 362/101 |
| 2002/0133991 | A1 | | 9/2002 | Nielson | |

* cited by examiner

*Primary Examiner*—William L. Miller
(74) *Attorney, Agent, or Firm*—Michael R. Schramm

(57) ABSTRACT

A supportive display container having an inner structure and an outer structure. The dimensions of the inner structure and the outer structure are such that when the outer structure has been placed over the inner structure, there is a gap between the side or sides of the inner structure and the side or sides of the outer structure which can hold an insert consisting of compressible material. The gap is of such a dimension that compression of the insert and friction prevent the inner structure and the outer structure from slipping apart. Preferably the side or sides of the outer structure are transparent to permit viewing of a message or design that is preferably on the insert. When the top of the inner structure is open, devices for stacking cubes, holders for cards, and display platforms can be inserted into the interior of the inner structure.

20 Claims, 29 Drawing Sheets

SUPPORTIVE DISPLAY CONTAINER

This nonprovisional utility application is a continuation of application Ser. No. 09/815,218 filed Mar. 22, 2001 and since issued as U.S. Pat. No. 7,234,258, the specification of which is incorporated herein by reference. The benefit of the filing date of this earlier filed application is claimed under 35 U.S.C. § 119(e) and 35 U.S.C. § 120.

BACKGROUND OF THE INVENTION

1. Field of the Invention

This invention relates to a container that can be used to display small banners or other objects such as cards or small decorative items and to support structures such as radios.

2. Description of the Related Art

A variety of display containers have been patented.

U.S. Pat. No. 2,548,706 covers a transparent solid body, preferably a cube, having a channel running around the lateral sides of the body slightly inward from the perimeter. A display sheet can be inserted into the channel for viewing.

A block having transparent outer walls forms the subject of U.S. Pat. No. 3,596,391. Inner walls are bowed centrally inward away from each face of the block and are intended to have art work placed upon their outer side.

The device of U.S. Pat. No. 3,703,045 has a transparent closed geometrical shape with one removable surface for inserting a similarly shaped inner structure where the central portions of each surface of the inner structure are indented to accommodate a photograph.

The structure of U.S. Pat. No. 3,716,936 closely resembles that of U.S. Pat. No. 3,703,045 except that the surfaces of the inner structure are not indented and that there is a base with a multi-sided cover that rests upon the base and fits over the inner structure.

Again, the display device of U.S. Pat. No. 3,774,332 resembles that of U.S. Pat. No. 3,703,045 except that the surfaces of the inner structure are not indented and that the outer structure consists of two U-shaped portions that fit together to form a hexagonal object.

Two five-sided boxes, one of which fits inside the other, are the subject of U.S. Pat. No. 4,195,729. The open portion of each box is placed at the top, and a cover is simultaneously placed over each box. The outer box is transparent, and photographs may be inserted between the sides of the two boxes.

An inner and an outer cubic body constitute the basic structure for U.S. Pat. No. 5,226,252. The outer cubic body has a bottom; the inner cubic body has an anchorage means on its top. Photographs can be placed between the adjacent sides of the two cubic bodies. The inner and outer cubic bodies are so constructed that they snap together using a protrusion on one body and a recess on the other body. As illustrated in FIG. 3, this locking means precludes a photograph from extending to the full height of the inner cubic body.

Furthermore, none of the devices of the preceding patents utilize the banner or photograph between adjacent walls to form a compression fit that holds the inner structure to the outer structure.

Nor can such devices be stacked with independent rotation of each device, and neither are any of the devices adapted to hold cards, such as baseball cards, above the device.

Finally, U.S. Pat. No. 6,012,185 deals with blocks for elevating the legs of beds; but none of the patents discussed herein suggest that they can function both as a display device and also support another structure.

SUMMARY OF THE INVENTION

Basically, the Supportive Display Container comprises an inner structure and an outer structure. The dimensions of the inner structure and the outer structure are such that when the outer structure has been placed over the inner structure, there is a small gap between the sides of the two which can, throughout the entire length of the sides, hold an insert consisting of a piece of paper or thin plastic having a design or message. The gap is of such a dimension that compression of the insert and friction prevent the inner structure and the outer structure from slipping apart.

Preferably, the side or sides of the outer structure are transparent in order to permit the insert to be viewed.

The cross-sectional shape of the inner structure and the outer structure can be any shape as long as they are the same, e.g., a circle (In this first case the inner structure and the outer structure would each have only one side.), a rectangle, or any other polygon (In the latter two cases the inner structure and the outer structure would each have multiple sides.). Preferably, however, when two sides meet at an angle, the connecting region is rounded to minimize the risk of damage to a continuous insert (banner); to preclude creasing the banner; and to permit rotation of the banner with respect to the sides of the outer structure with only the necessity to remove the inner structure, not the banner also.

Optionally, a support is held within the interior of the inner structure, preferably by friction. Together with a pedestal upon which the support may be rotatably mounted, the support permits the Supportive Display Container to be rotated and allows separate Containers to be placed atop one another for simultaneous or separate rotation.

Alternatively, a string or wire can be attached to the support to suspend the Supportive Display Container; or a holder for cards, rings, or other objects can be attached to the support.

Also, a soft stacking ring with a high coefficient of friction may be placed between adjacent Supportive Display Containers that are stacked on top of each other if it is not desired to have the Containers rotate independently of one another.

DESCRIPTION OF THE PREFERRED EMBODIMENT

Figure 1:
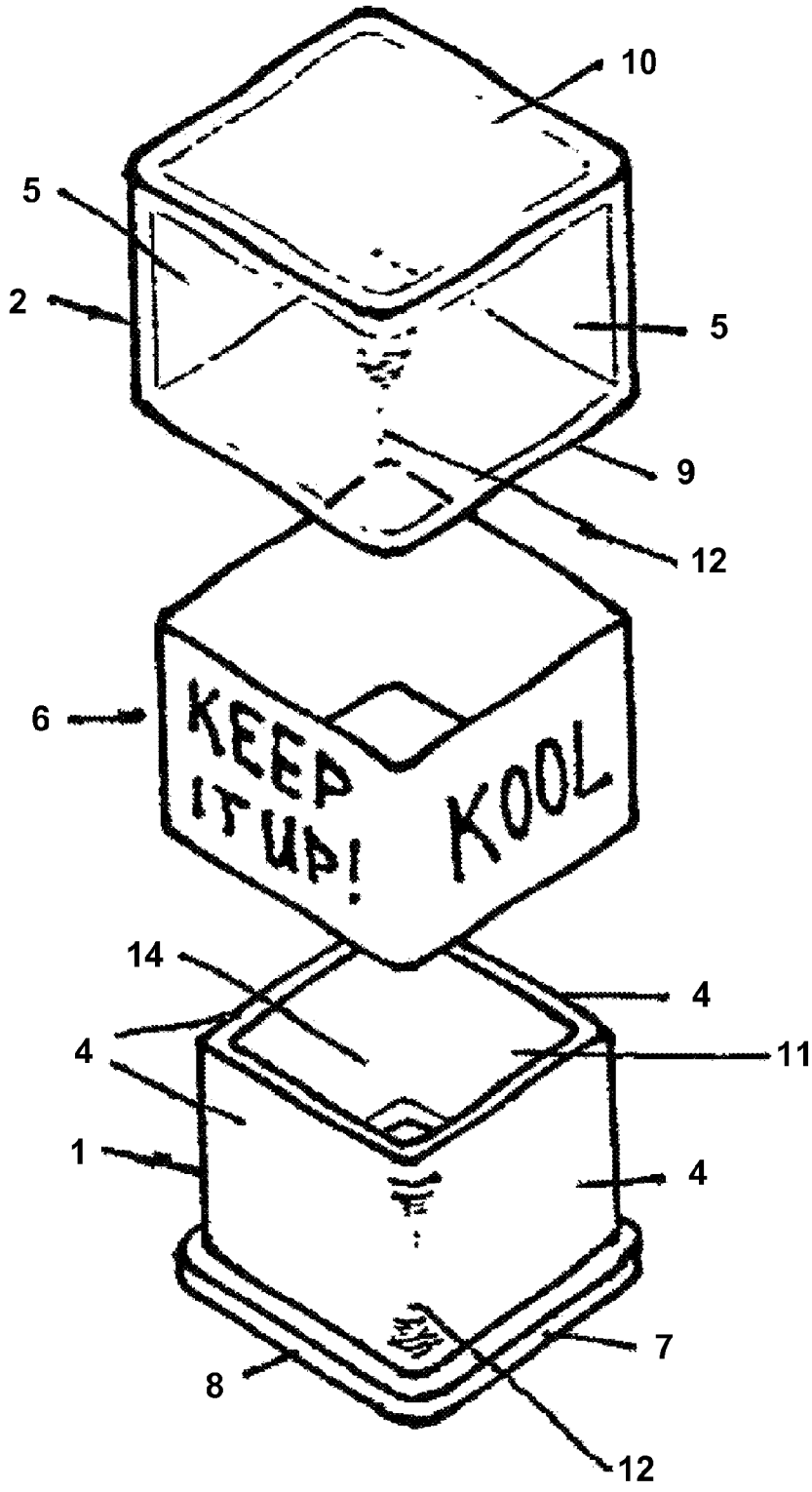
FIG. 1 is an exploded view of the Supportive Display Container.
Figure 2:
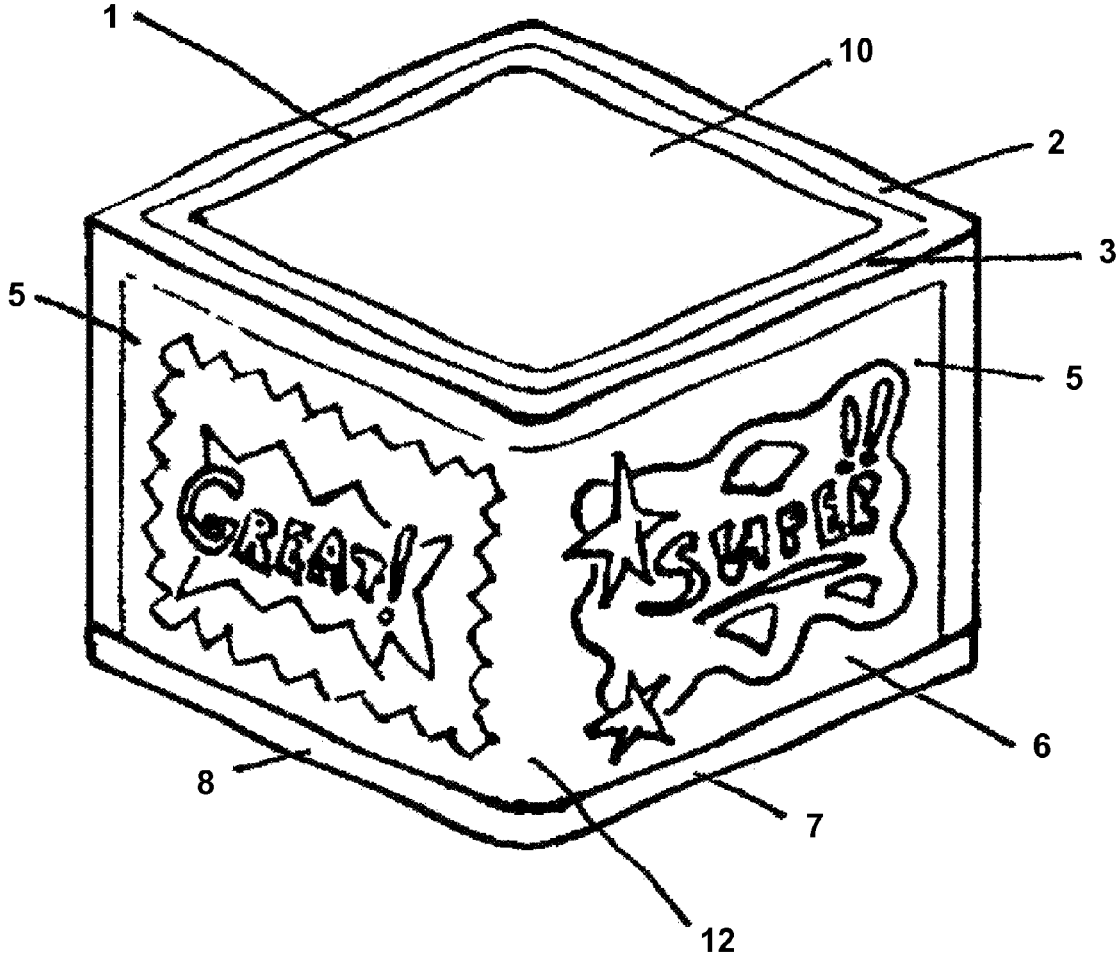
FIG. 2 shows the assembled Supportive Display Container.

As illustrated in FIG. 1 and as discussed above, the Supportive Display Container comprises an inner structure 1 and an outer structure 2. The dimensions of the inner structure 1 and the outer structure 2 are such that when the outer structure 2 has been placed over the inner structure 1, as shown in FIG. 2, there is a gap 3 between the side 4 (There would only be one side 4 if, for example, the cross-sectional shape of the inner structure 1 and the outer structure 2 were a circle.) or sides 4 of the inner structure 1 and the side 5 or sides 5 of the outer structure 2 which can hold an insert 6 consisting of compressible material, such as a piece of paper or thin plastic, and preferably having a design or message. The gap 3 is of such a dimension that compression of the insert 6 by the sides 4, 5 and friction prevent the inner structure 1 and the outer structure 2 from slipping apart.

Preferably, as discussed above, the side 5 or sides 5 of the outer structure 2 are transparent in order to permit the insert to be viewed. The inner structure 1 and the outer structure 2 can be constructed from any type of plastic but preferably polycarbonate resin such as Lexan Polycarbonate resin which is manufactured by General Electric Company.

The inner structure 1 preferably has a flange 7 at the top 8 to provide a support and stop for the outer structure 2 if the dimensions of the inner structure 1 would not accomplish this. The top end 9 of the outer structure 2 must be open to accommodate the inner structure 1; the bottom 10 and side 5 or sides 5 of the outer structure 2 are closed.

If there is no flange 7, the dimensions of the side 4 or sides 4 of the inner structure 1 and the side 5 or sides 5 of the outer structure 2 are preferably such that the top 8 of the inner structure 1 is aligned with the top end 9 of the outer structure 2 when the inner structure 1 has been placed within the outer structure 2.

The inner structure 1 can have either end, i.e., the top 8 or the bottom 11, either open or closed; the side 4 or sides 4 are closed. If the inner structure 1 has an open top end 8, the Supportive Display Container can then, indeed, function as a container.

The cross-sectional shape of the inner structure I and the outer structure 2 can be any shape as long as both the inner structure 1 and the outer structure 2 have the same shape, e.g., a circle, a rectangle, or a polygon. Preferably, however, as discussed above, when two sides 4 or 5 meet at an angle, the connecting region 12 formed by such meeting is rounded to minimize the risk of damage to a continuous insert 6, such as a banner; to preclude creasing the continuous insert 6; and to permit rotation of the continuous insert 6 with respect to the sides 5 of the outer structure 2 with only the necessity to remove the inner structure 1, not the continuous insert 6 also.

Figure 3:
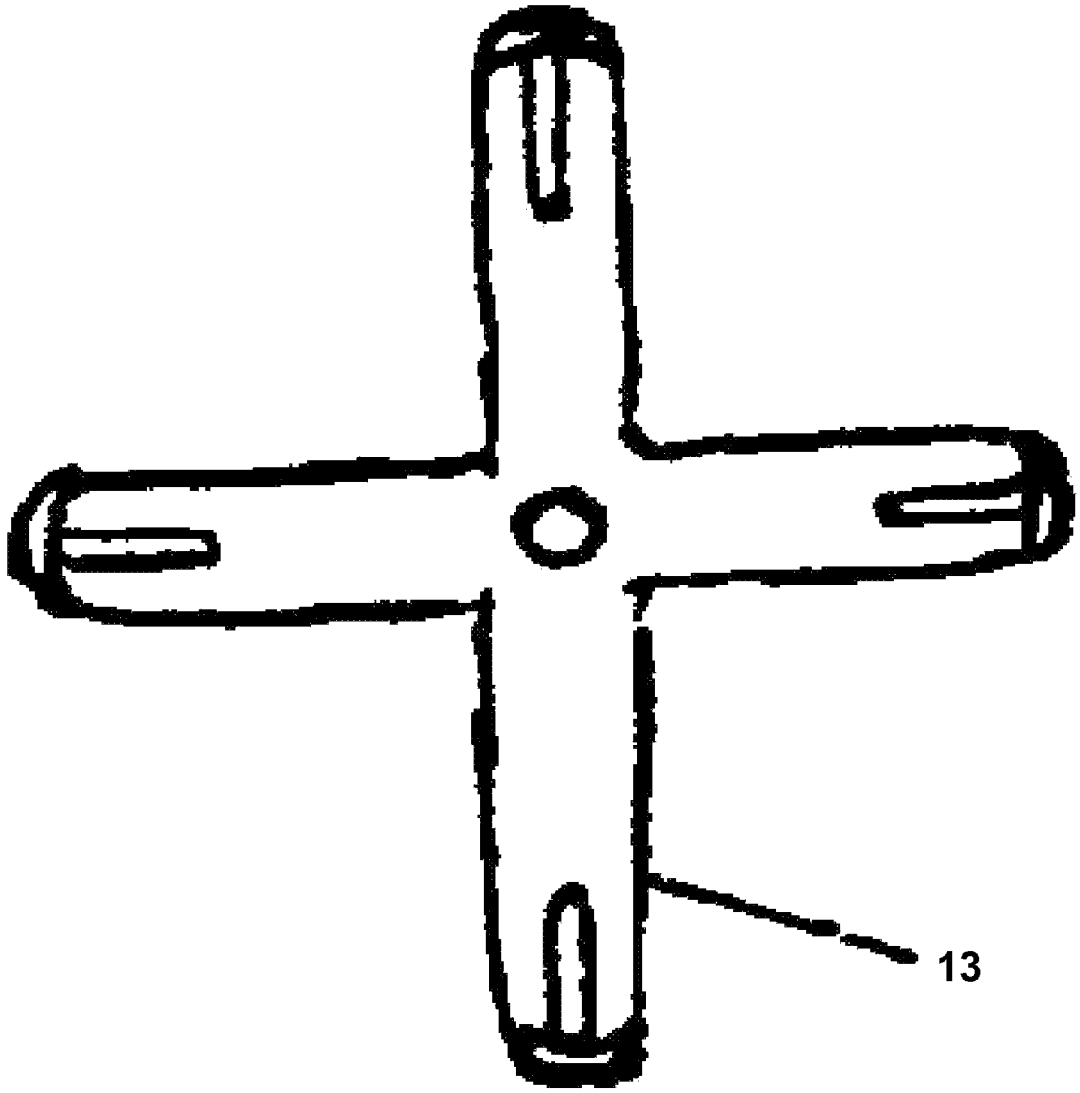
FIG. 3 is a plan view of a support that can be held within the interior of the inner structure of the Supportive Display Container.
Figure 4:
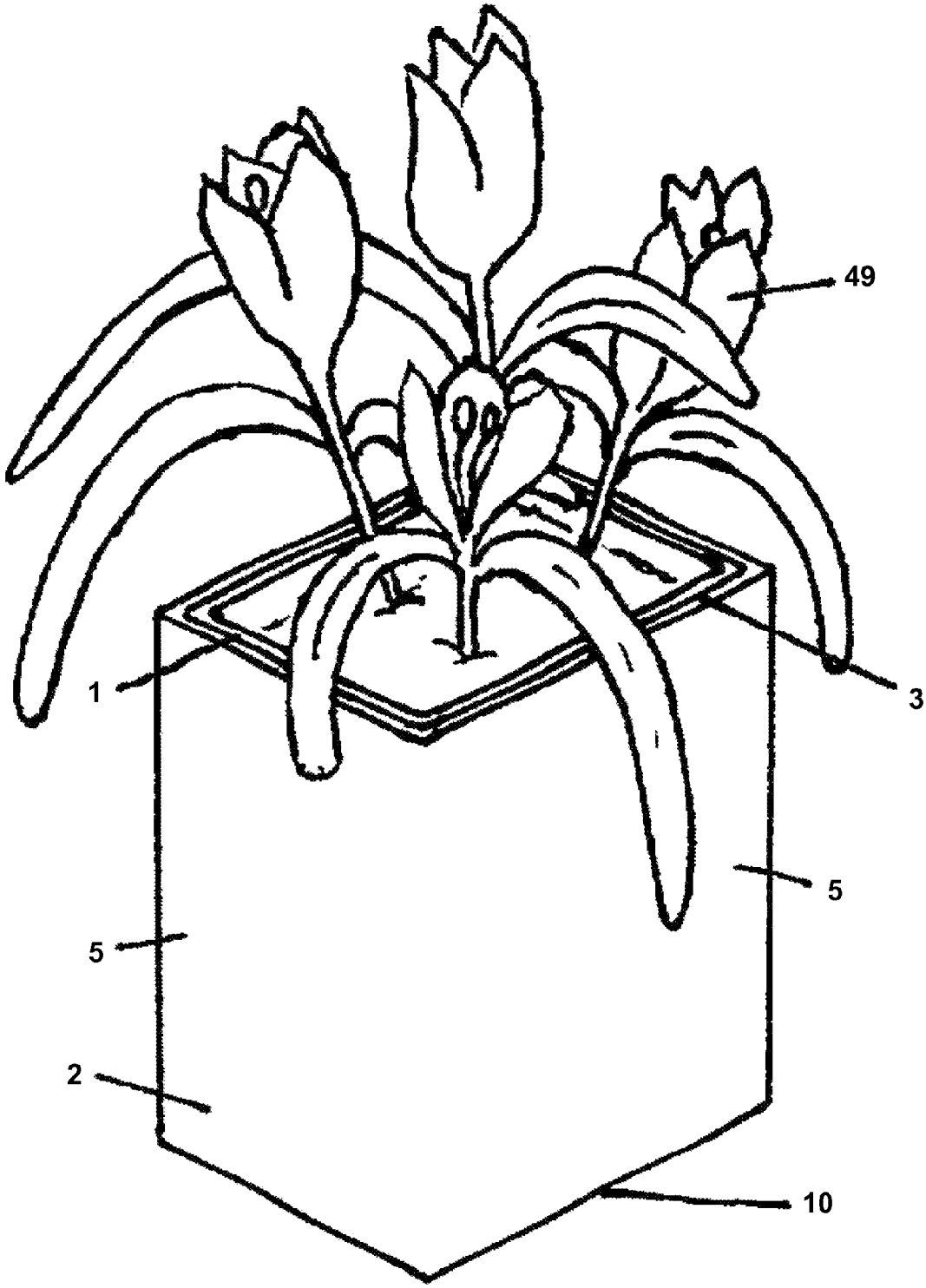
FIG. 4 is a side view of the support that can be held within the interior of the inner structure of the Supportive Display Container.
Figure 5:
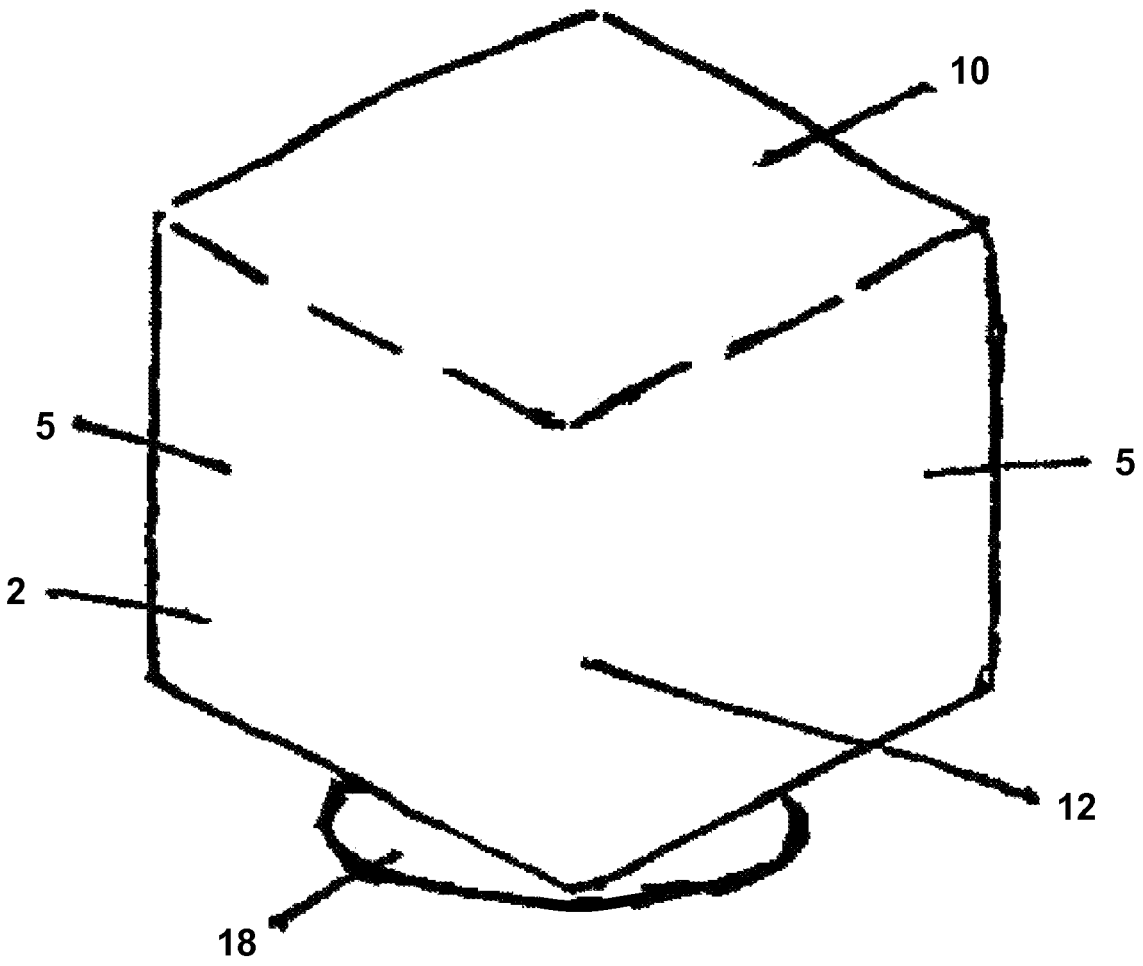
FIG. 5 illustrates the Supportive Display Container rotatably mounted upon a first end of a pedestal.
Figure 6:
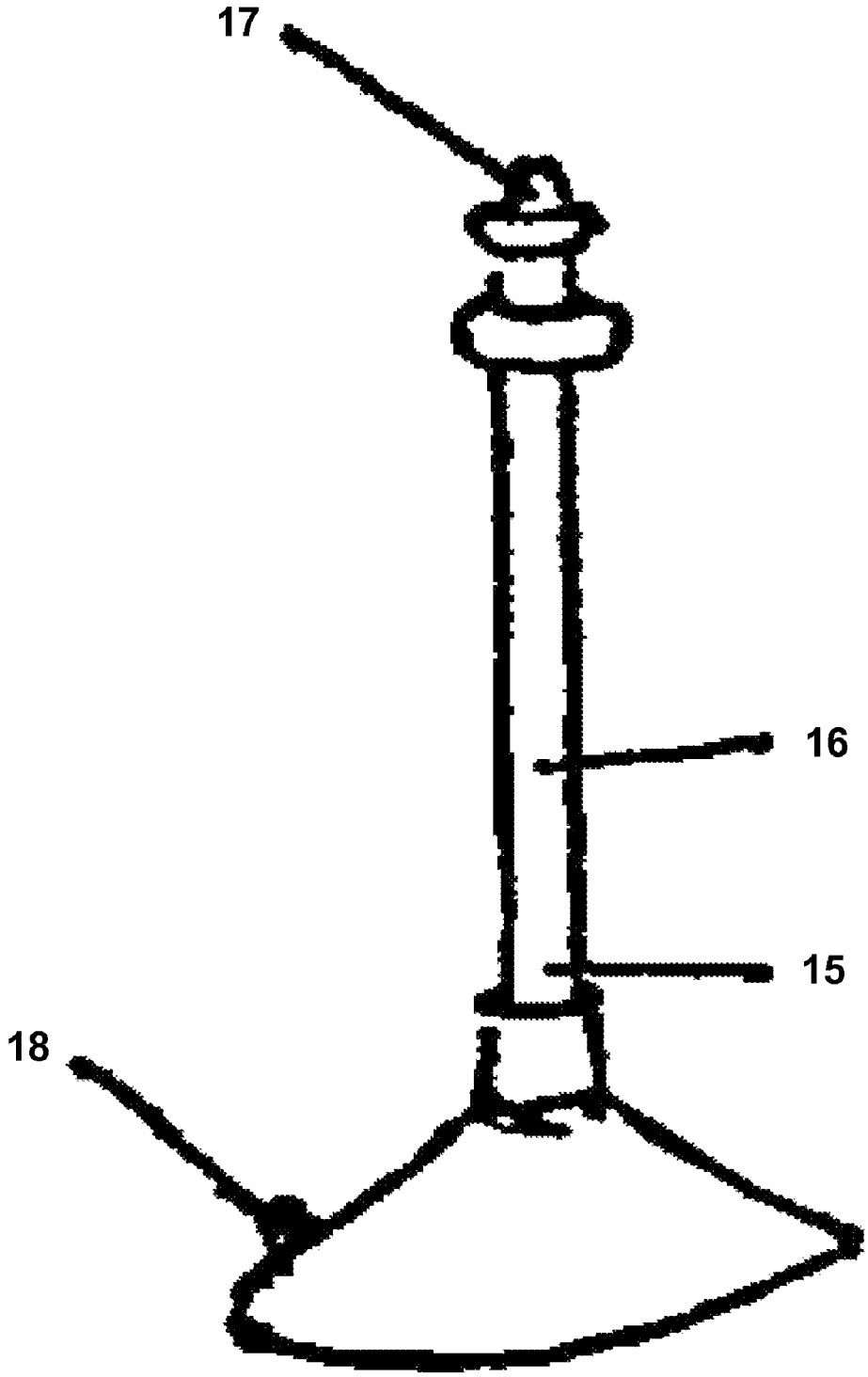
FIG. 6 portrays the pedestal.
Figure 7:
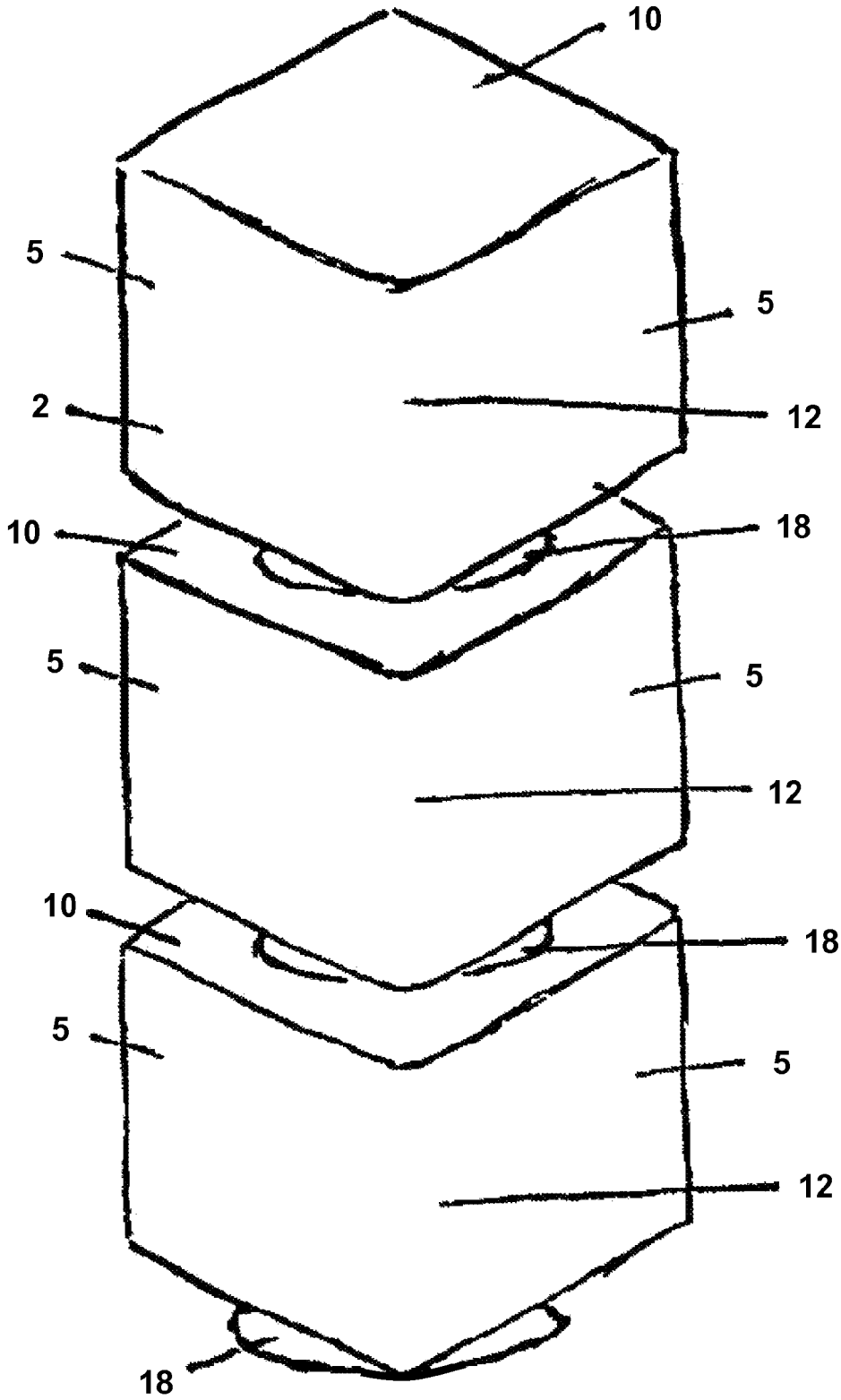
FIG. 7 shows separate Supportive Display Containers rotatably placed atop one another.

Optionally, when the inner structure 1 has an open top 8, a support 13, which is depicted in FIGS. 3 and 4, is held within the interior 14 of the inner structure 1, preferably by friction. In one embodiment the support 13 is rotatably mounted, as illustrated in FIG. 5, upon a first end 15 of a pedestal 16, the second end 17 of which pedestal 16 is, as portrayed in FIG. 6, attached to a base 18 that is preferably a suction cup. Then when the combined outer structure 2, inner structure 1, support 13, and pedestal 16 is inverted, the Supportive Display Container can be rotated; and separate Containers can be placed atop one another, as demonstrated in FIG. 7, for simultaneous or separate rotation.

Figure 8:
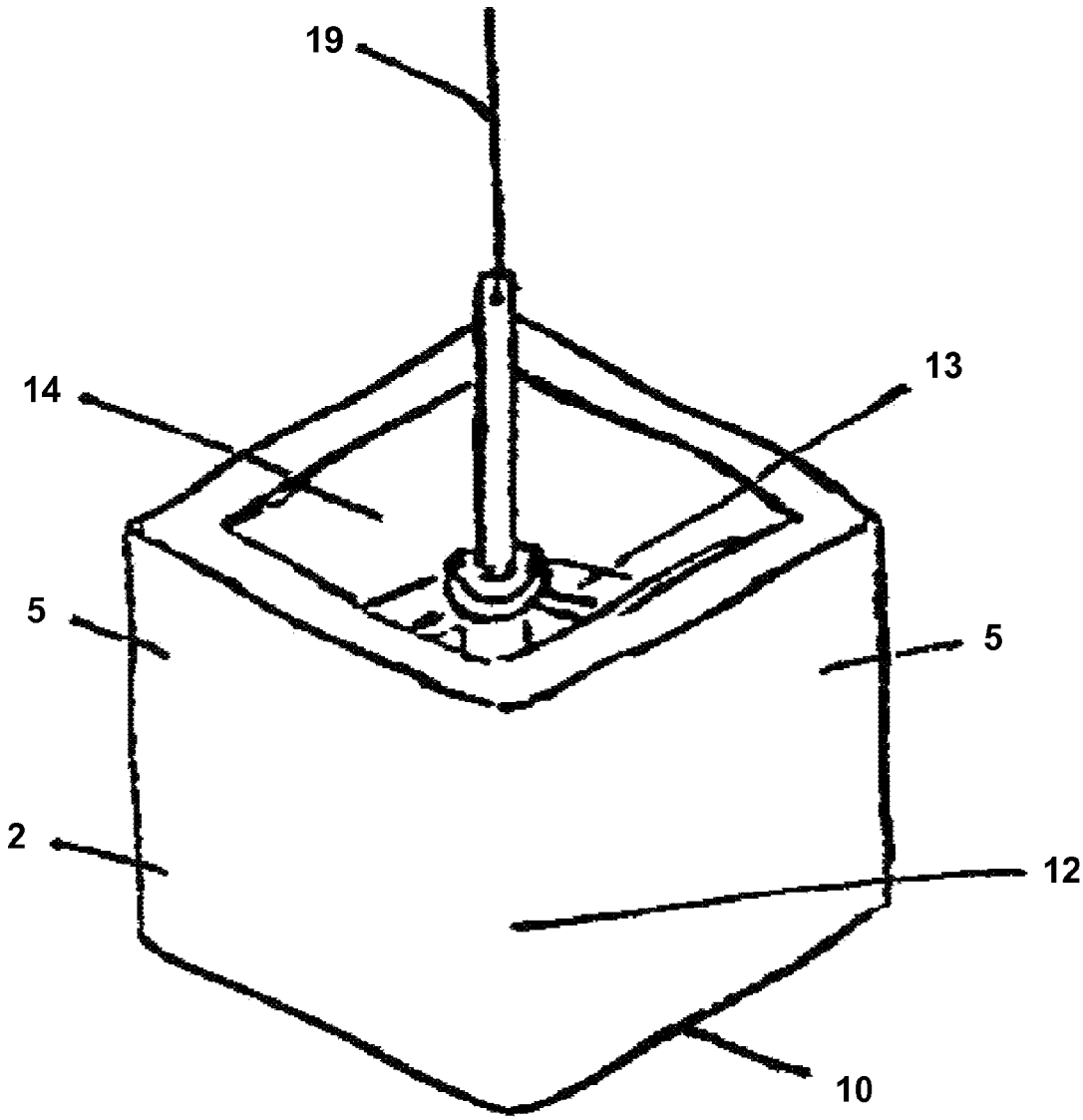
FIG. 8 displays a string or wire attached to a support to suspend the Supportive Display container.
Figure 9:
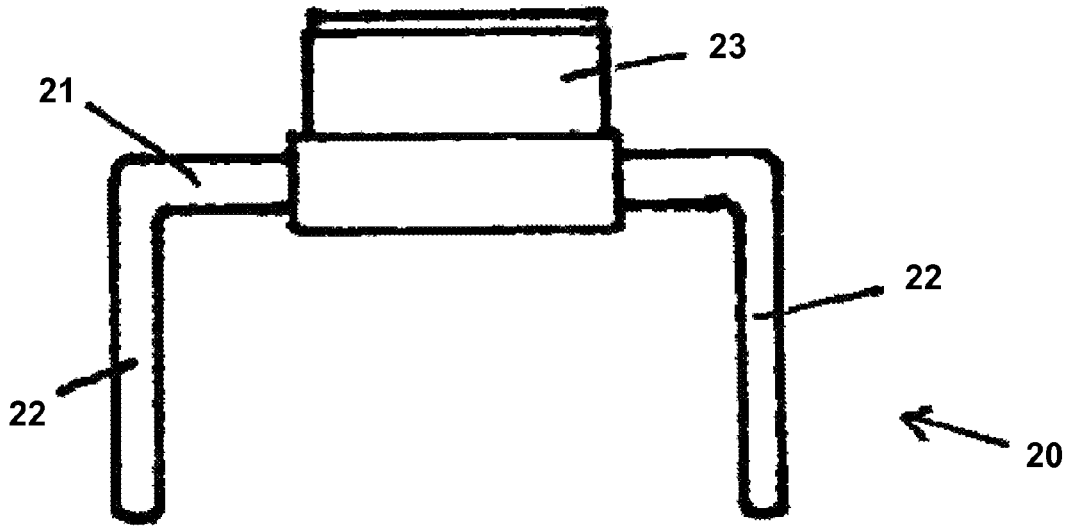
FIG. 9 shows a holder for a single card.
Figure 10:
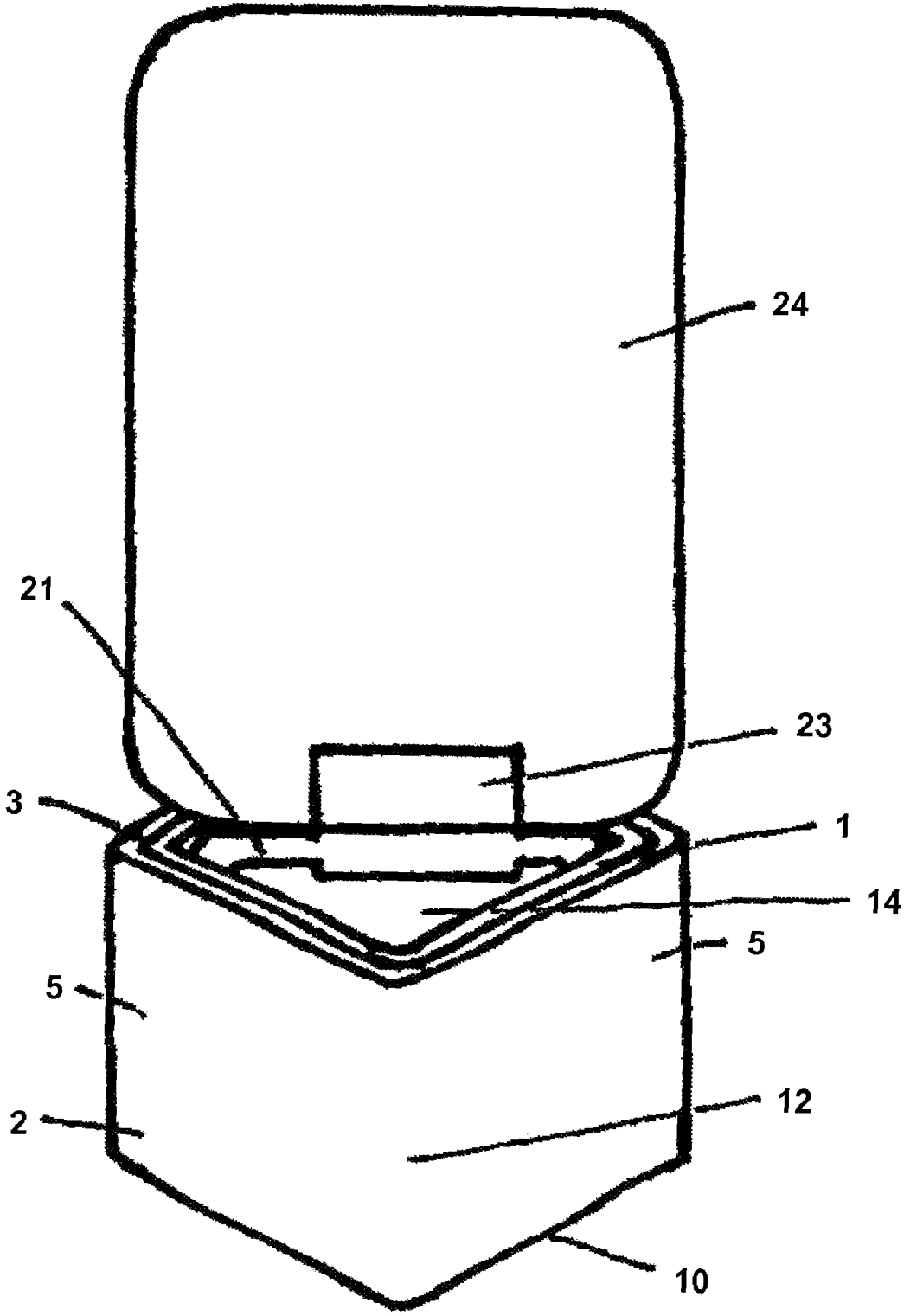
FIG. 10 depicts the holder of FIG. 8 inserted into the inner structure of a Supportive Display Container.
Figure 11:
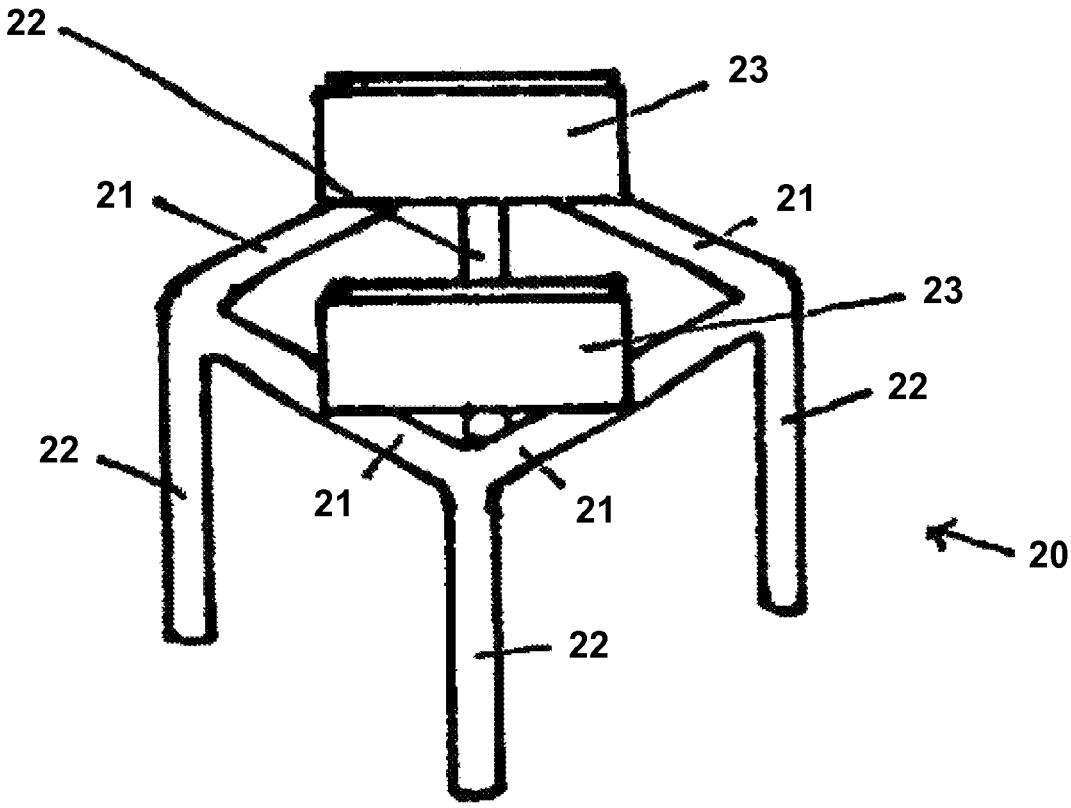
FIG. 11 illustrates a holder for two cards.
Figure 12:
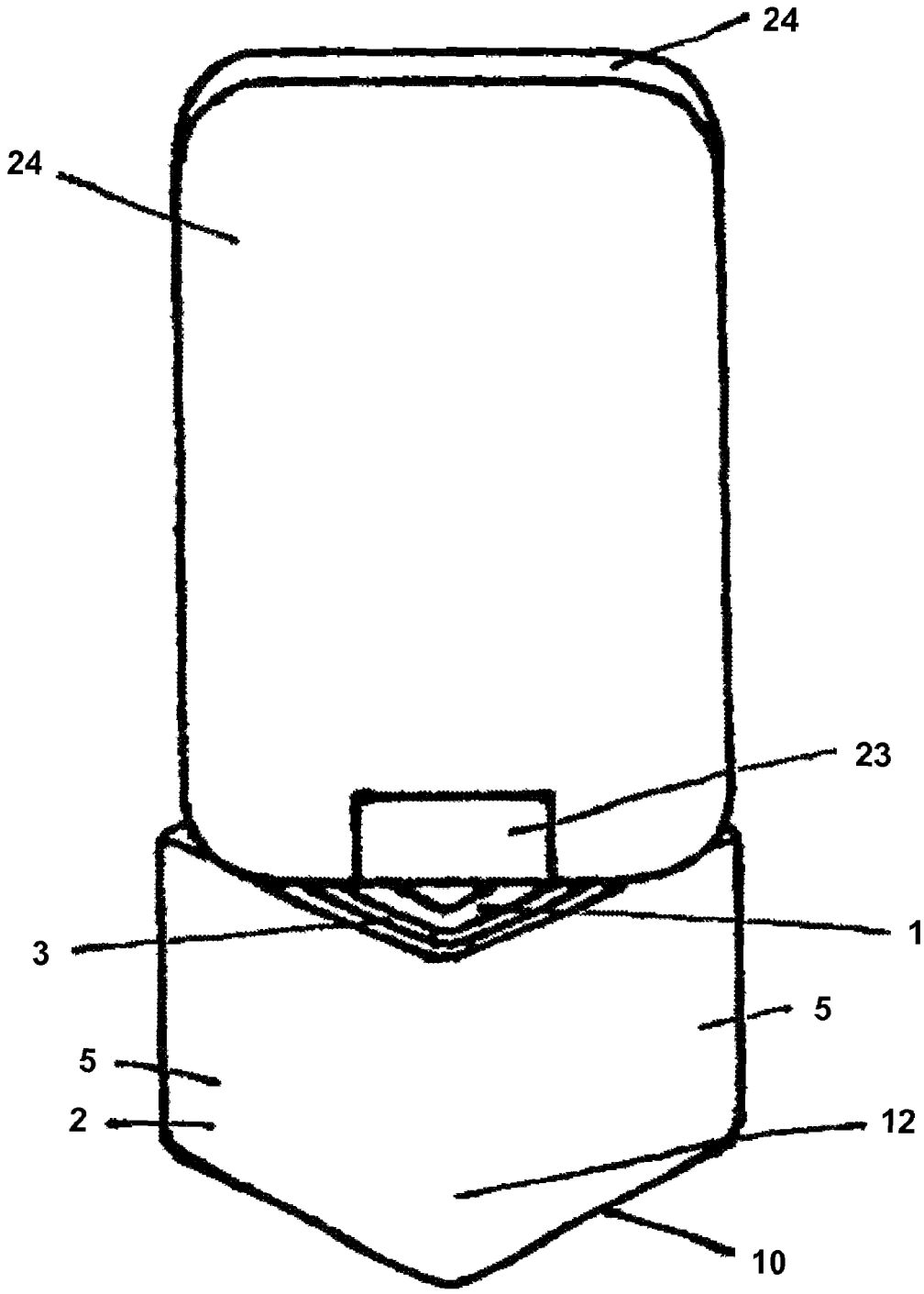
FIG. 12 portrays the holder of FIG. 11 inserted into the inner structure of a Supportive Display Container.
Figure 13:
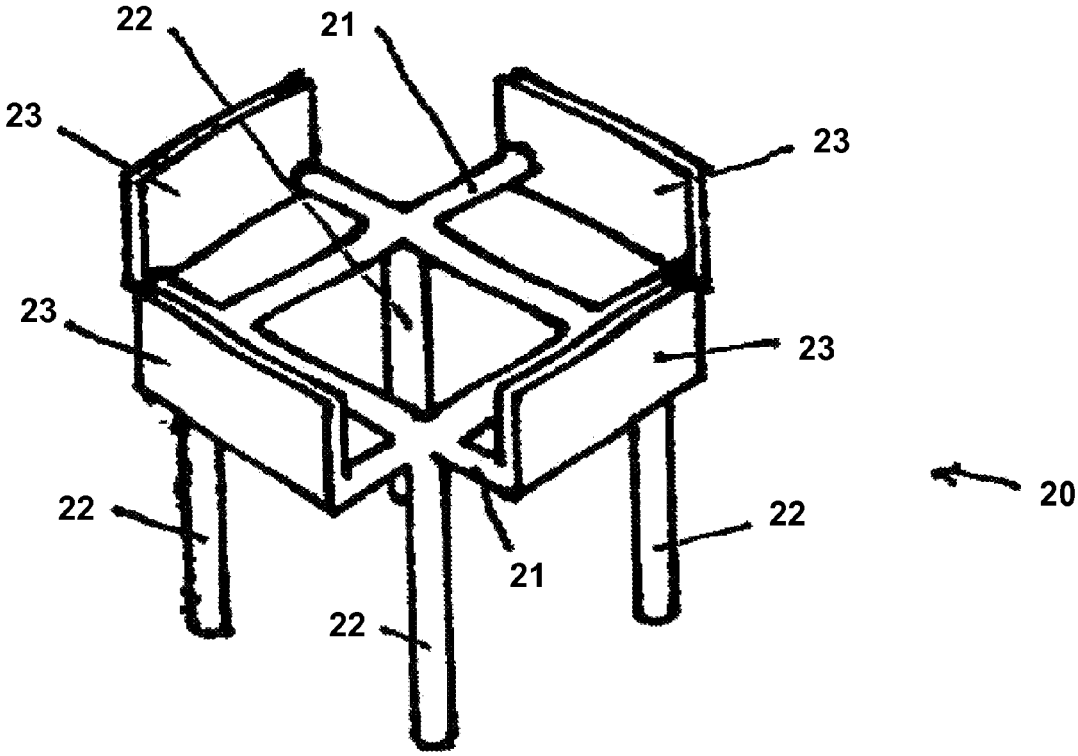
FIG. 13 shows a holder for four cards.
Figure 14:
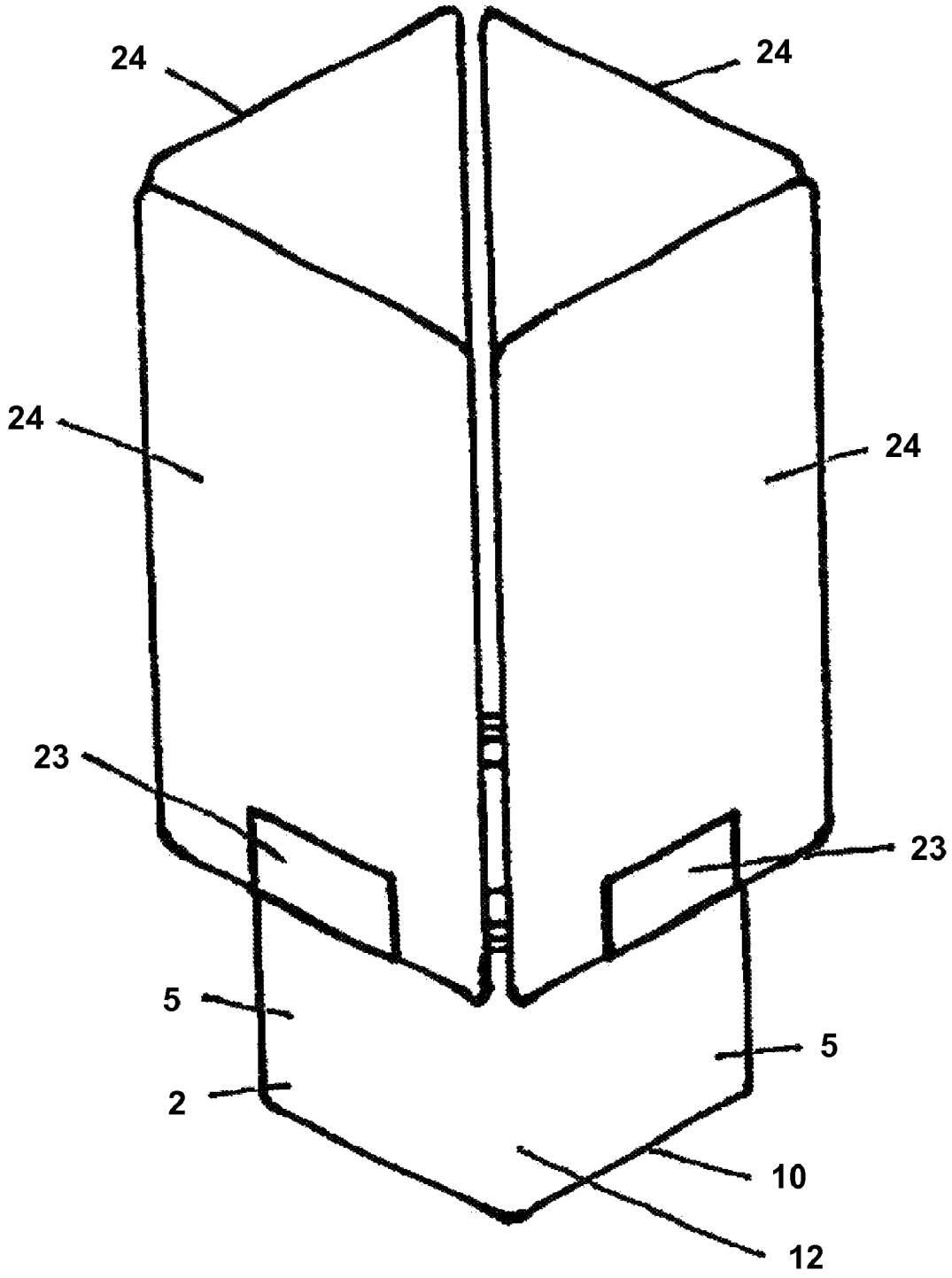
FIG. 14 depicts the holder of FIG. 12 inserted into the inner structure of a Supportive Display Container.

In another embodiment, illustrated in FIG. 8, a string or wire 19 can be attached to the support 13 to suspend the Supportive Display Container.

And in a further embodiment, portrayed in FIGS. 9, 10, 11, 12, 13, and 14, a holder 20 for cards is inserted into the inner structure 1. The holder 20 comprises a horizontal surface 21 attached to two or more legs 22. Attached to the horizontal surface 21 is one or more sleeves 23 into which a card 24 can be inserted.

Figure 15:
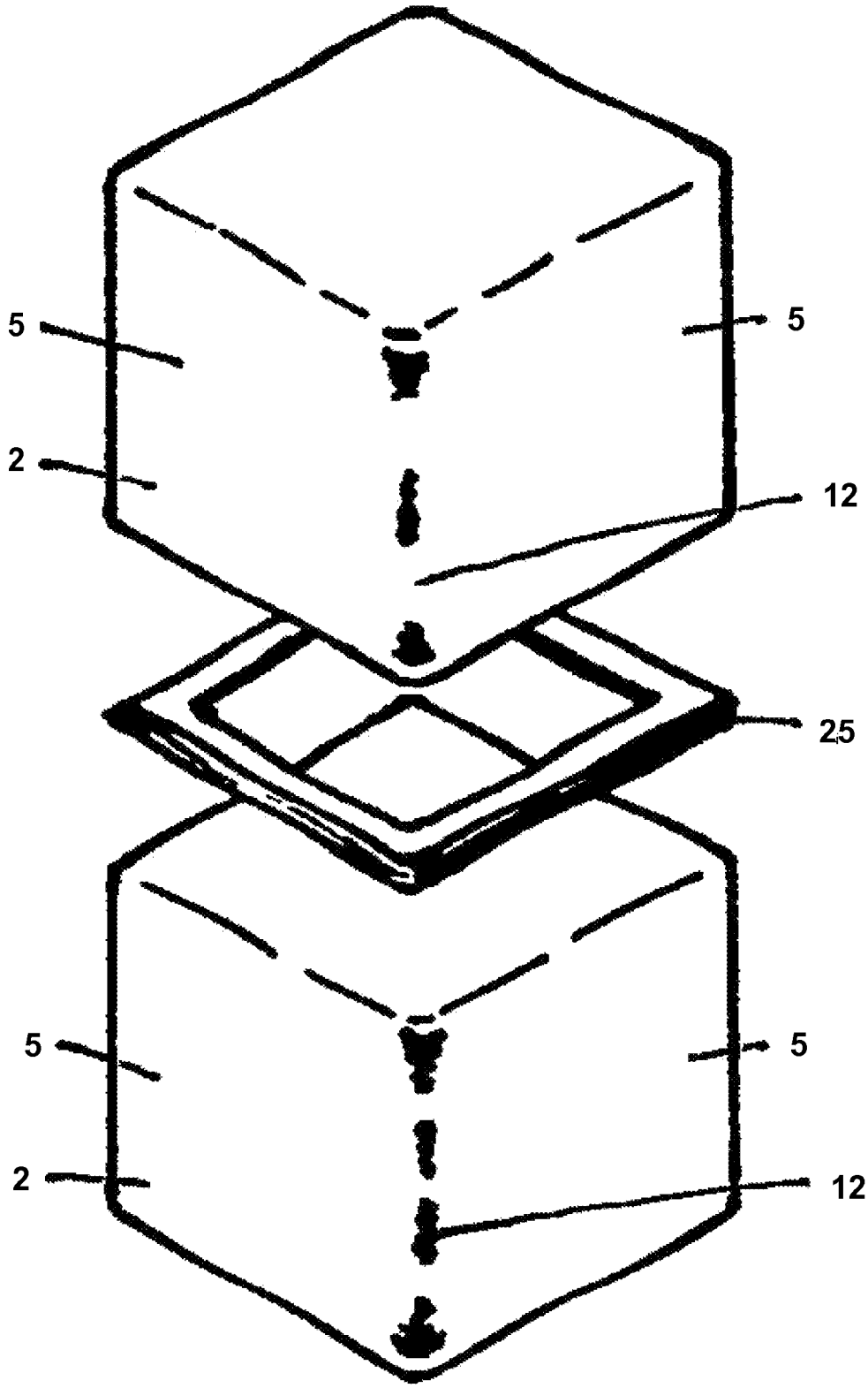
FIG. 15 portrays a stacking ring between two Supportive Display Containers.

If it is desired to stack Containers without having them independently rotatable, a stacking ring 25 is, as illustrated in FIG. 15, placed between adjacent Containers. The stacking ring 25 preferably has the same cross-sectional shape as the inner structure 1 and the outer structure 2. The stacking ring 25 is preferably made from material that is soft and has a high coefficient of friction, in order to protect the Containers and reduce the possibility of their slipping. A preferred material for this purpose is neoprene memory foam.

Figure 16:
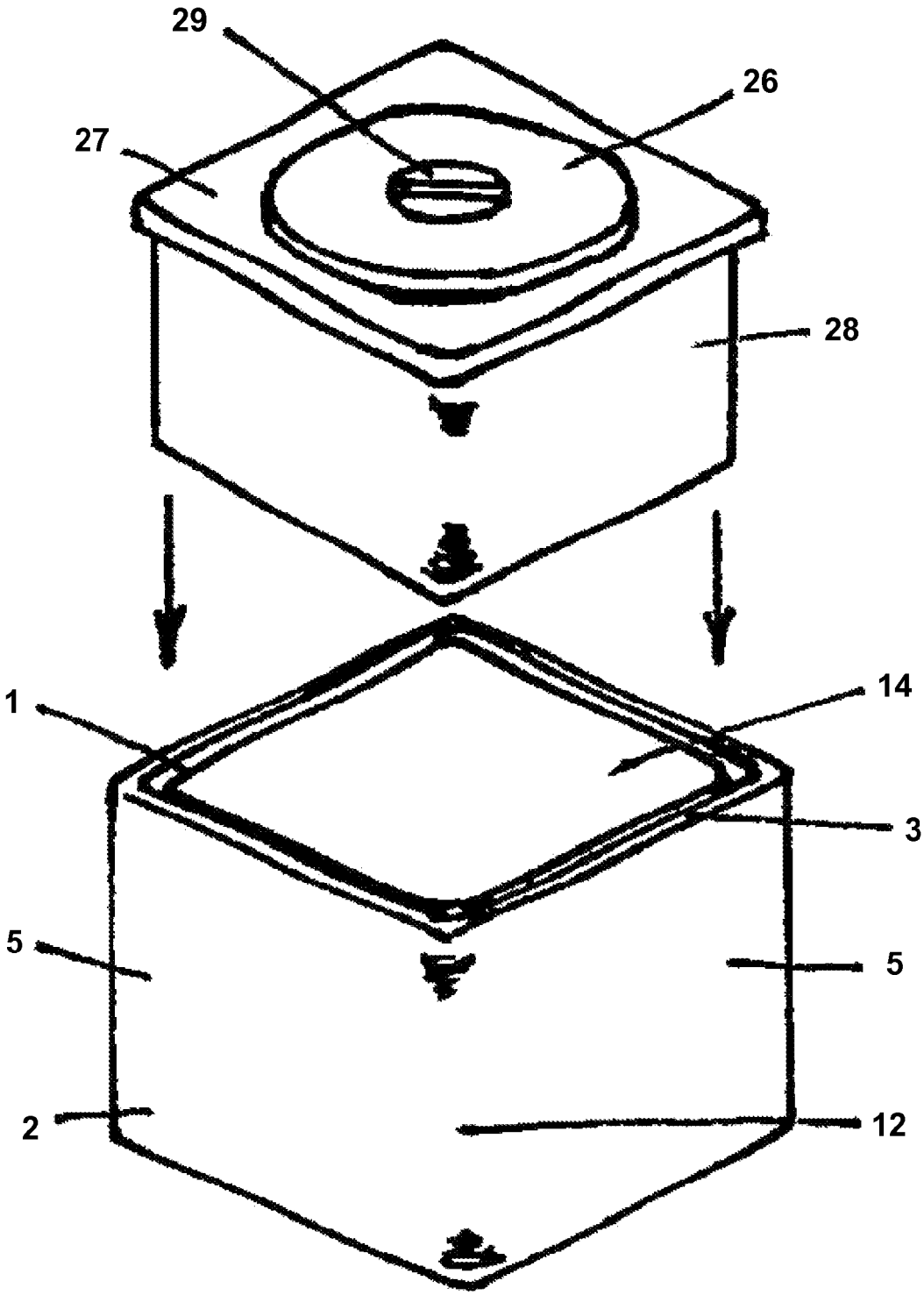
FIG. 16 depicts a disk rotatably attached to the top of a platform that fits into the inner structure of a Supportive Display Container.
Figure 17:
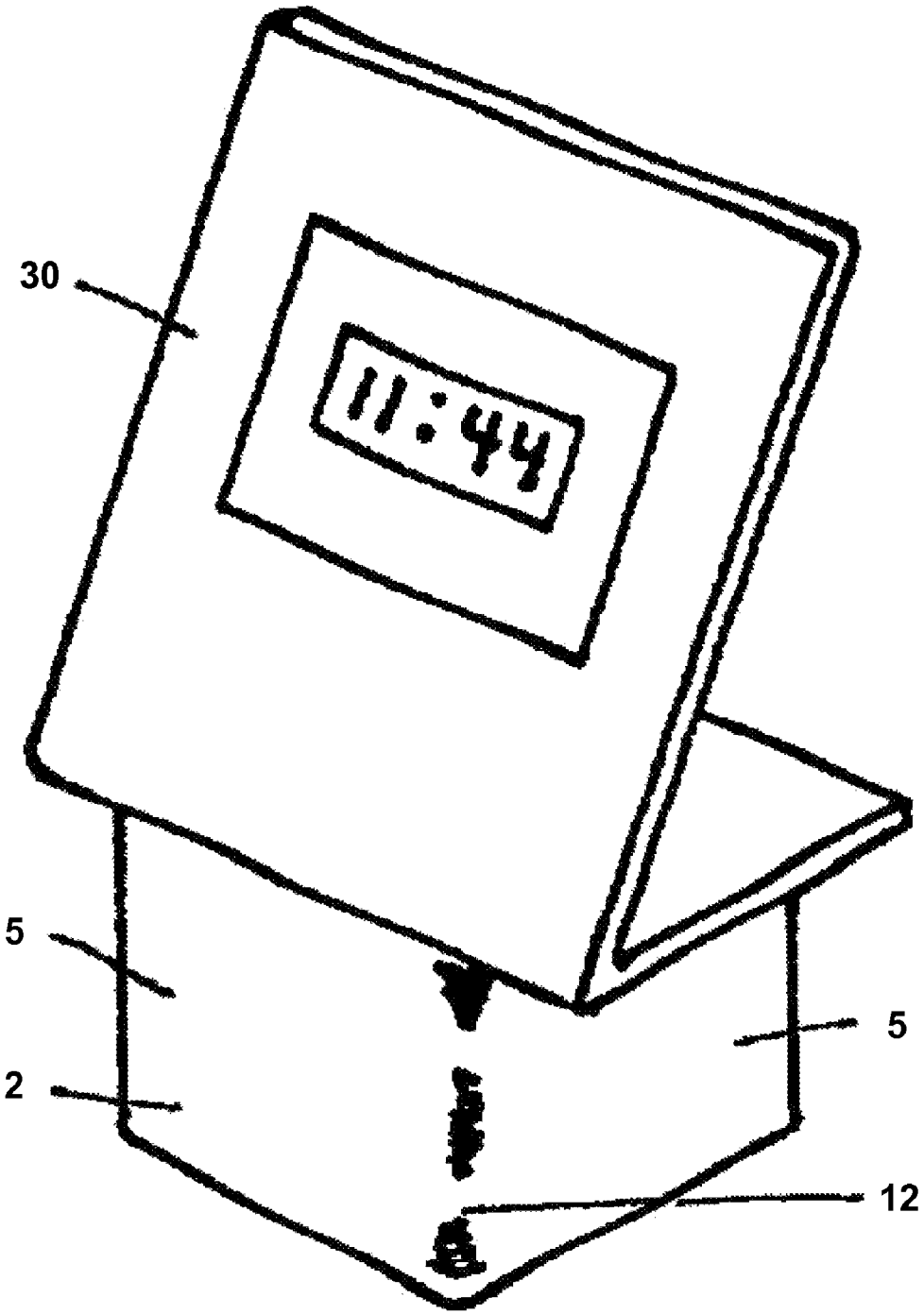
FIG. 17 illustrates a clock attached to the disk in the embodiment of FIG. 16.
Figure 18:
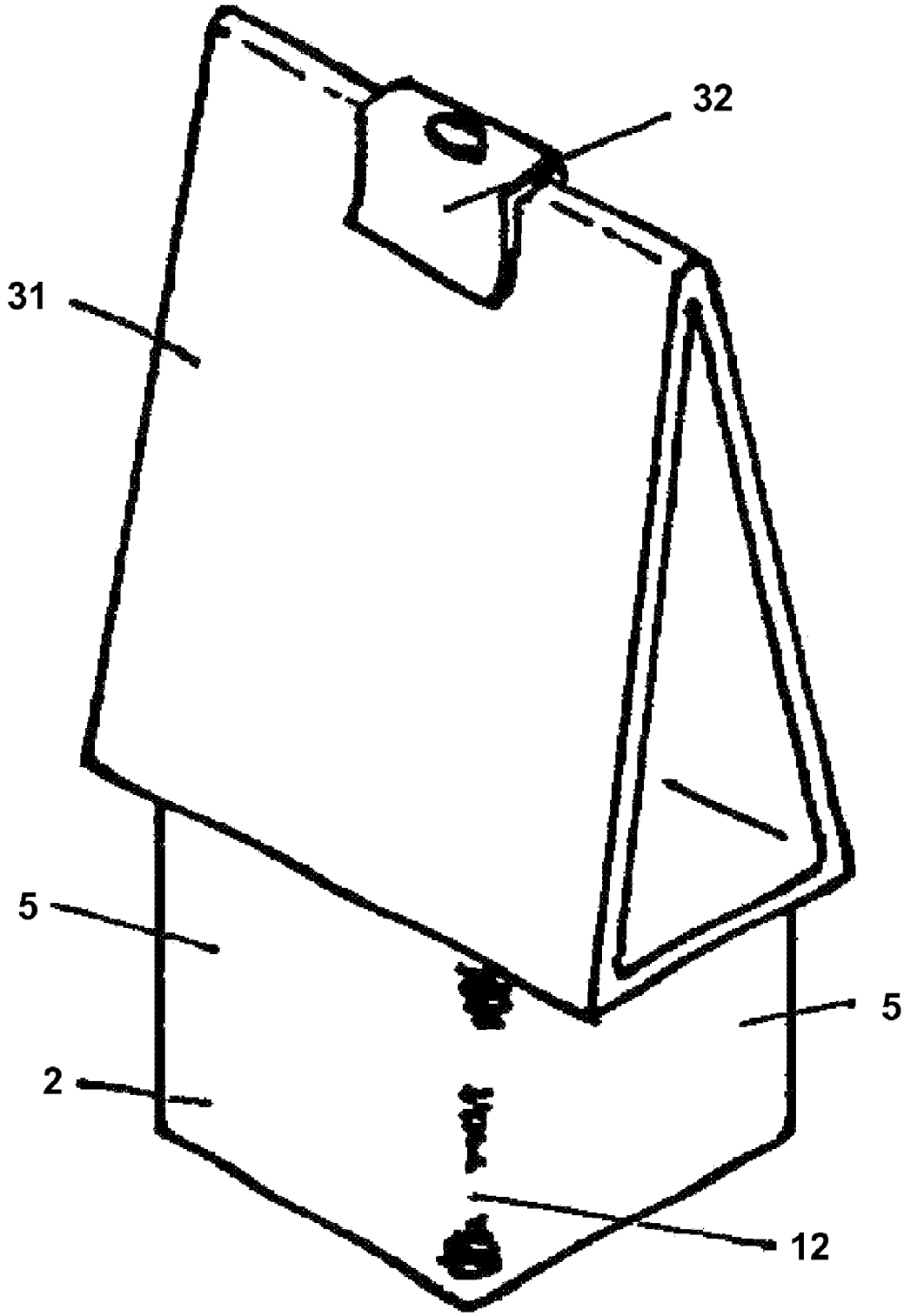
FIG. 18 shows an easel having a retaining clip connected to the disk in the embodiment of FIG. 16.
Figure 19:
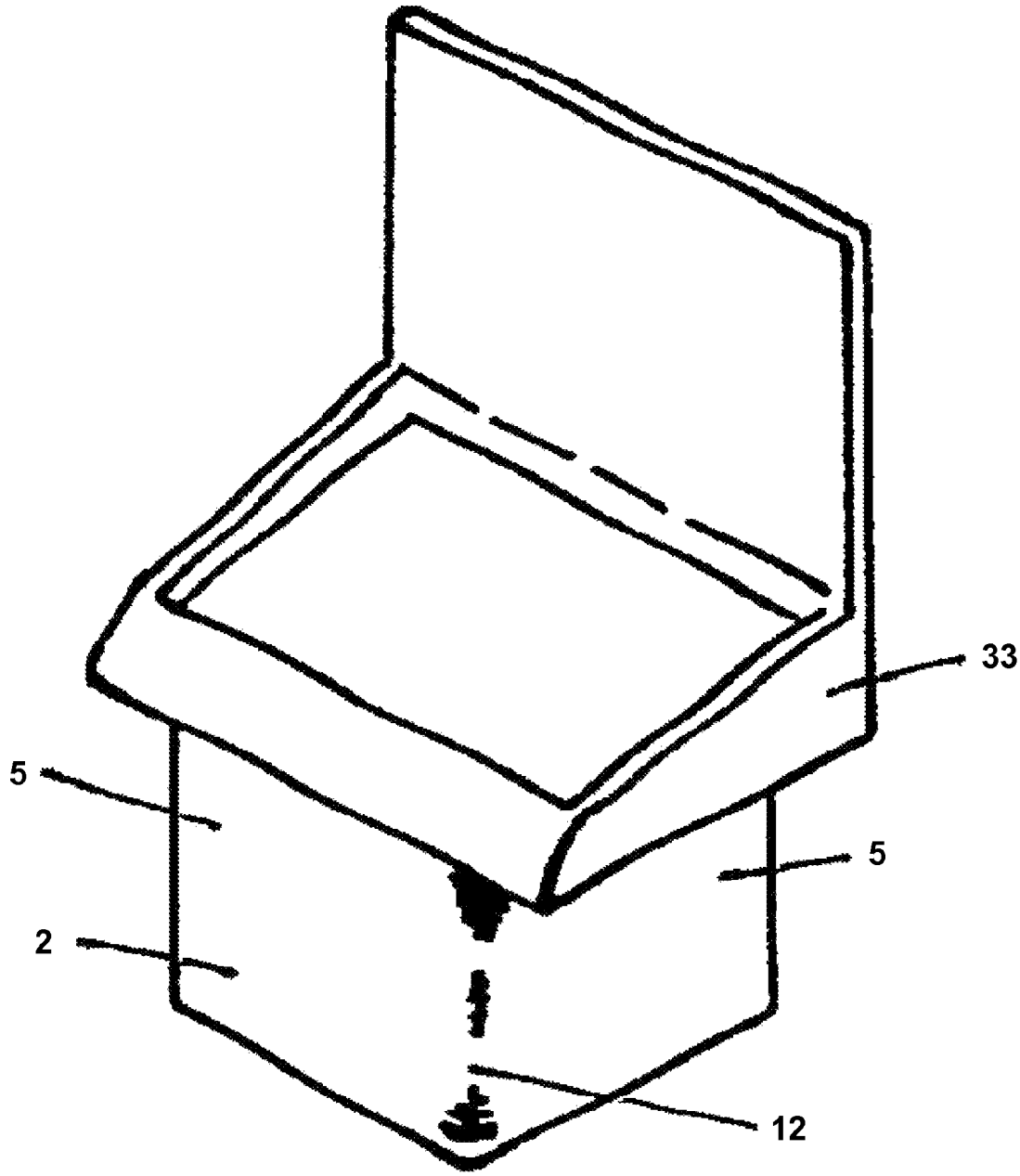
FIG. 19 portrays a display platform attached to the disk in the embodiment of FIG. 16.

Also, a disk 26 is, either permanently or releasably, rotatably attached to the top 27 of a platform 28 that fits into the inner structure 1, as illustrated in FIG. 16. Preferably, such rotatable attachment is accomplished with a screw 29 in any manner that is well known in the art. To the disk 26 may be attached a clock 30, as shown in FIG. 17; an easel 31 having a retaining clip 32, as portrayed in FIG. 18; or a display platform 33, as depicted in FIG. 19.

The disk 26 also provides an alternate way to rotate stacked Containers.

Figure 20:
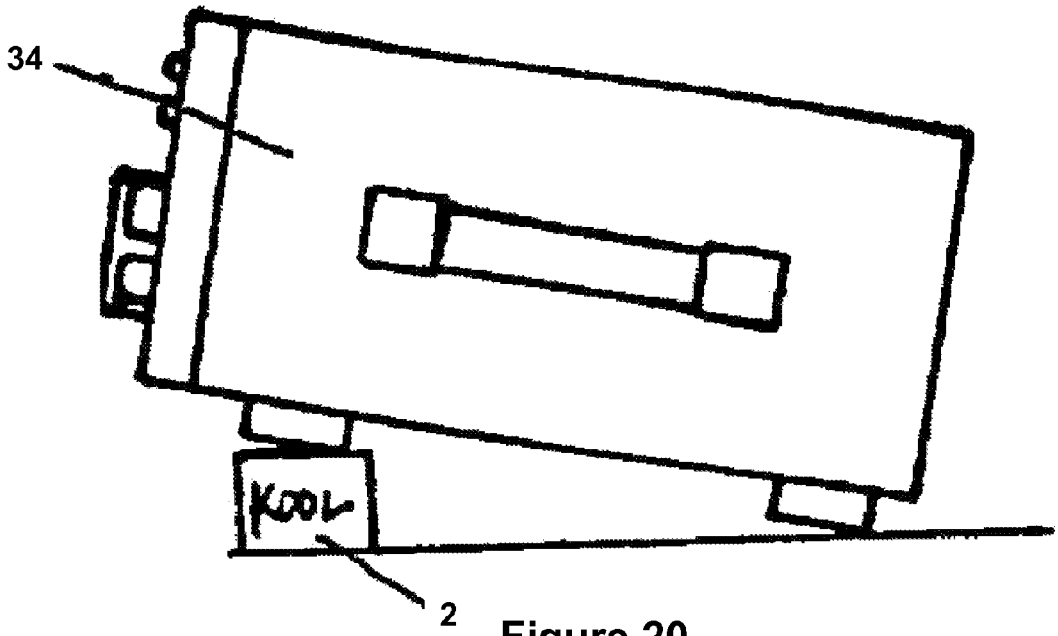
FIG. 20 is a side view of an amateur radio supported by Supportive Display Containers.
Figure 21:
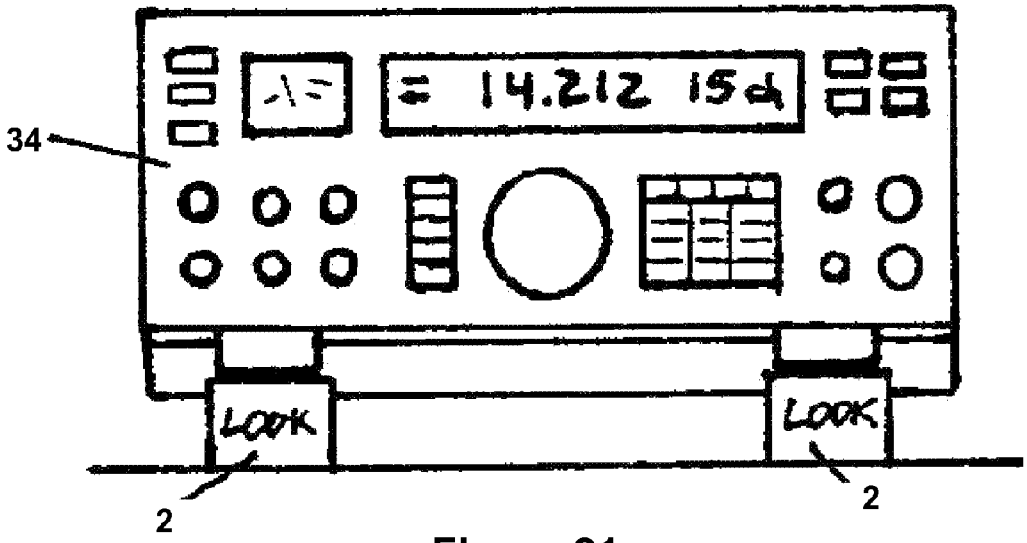
FIG. 21 is a view from the front of an amateur radio supported by Supportive Display Containers.
Figure 22:
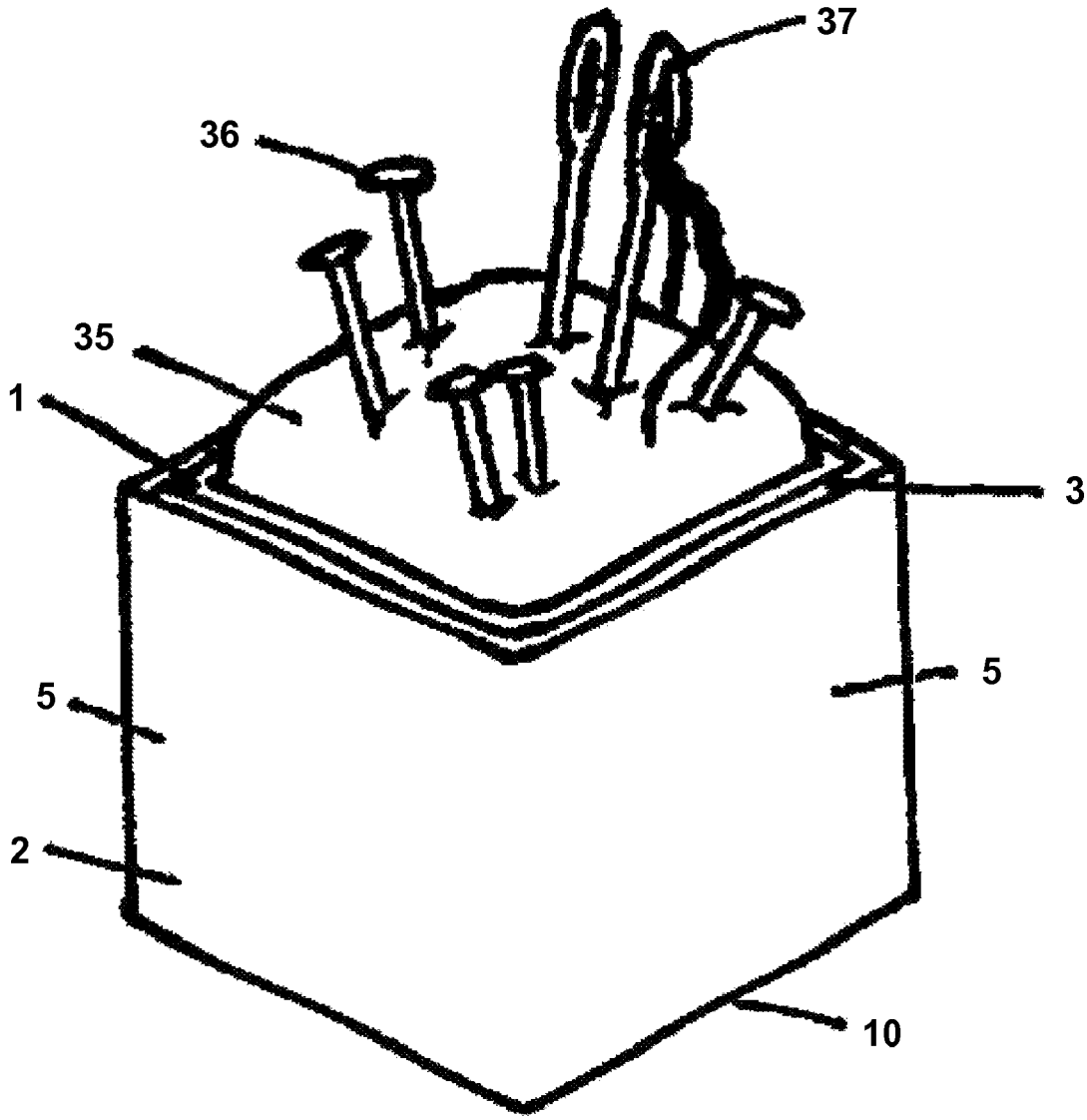
FIG. 22 shows the Supportive Display Container with an open top on the inner structure and holding a cushion with pins and needles inserted into the cushion.
Figure 23:
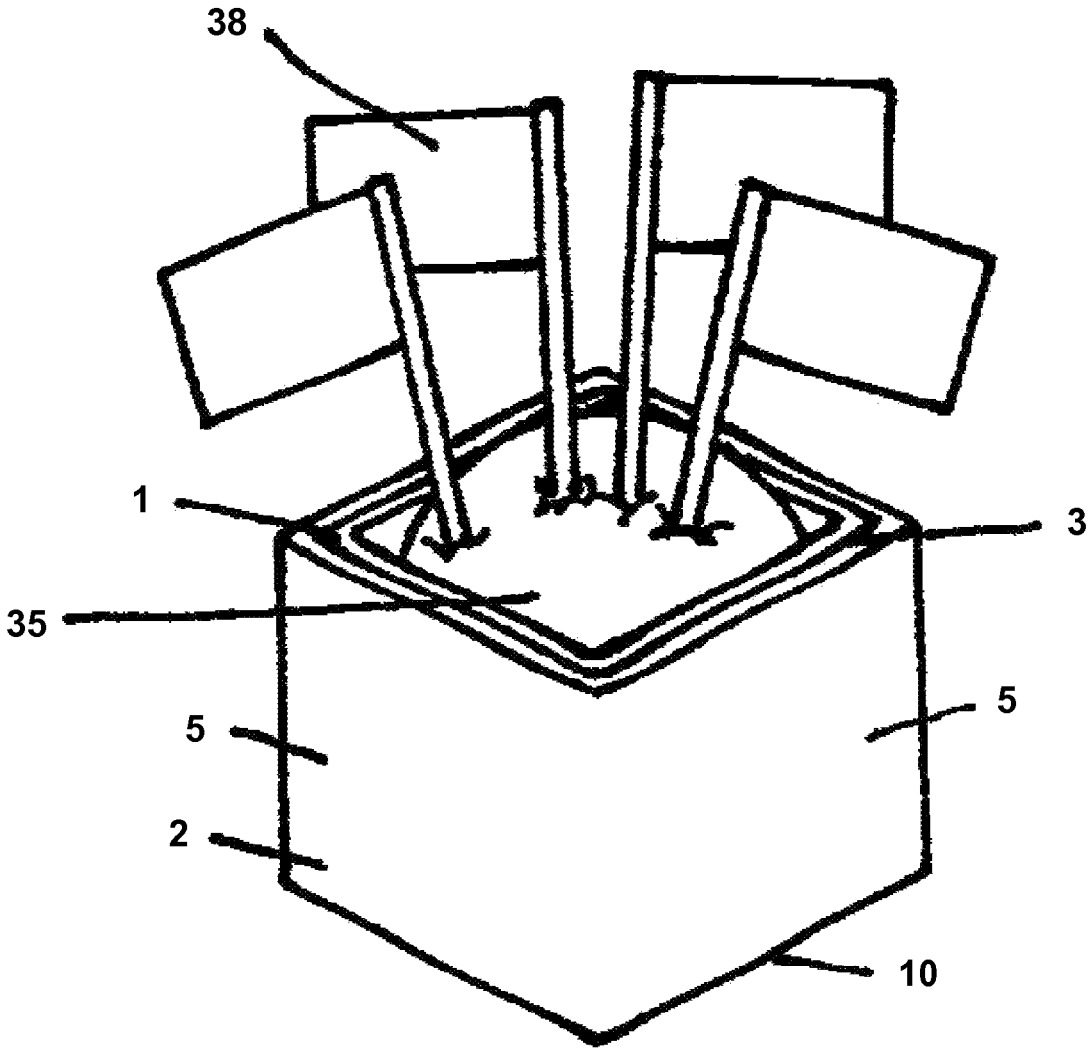
FIG. 23 depicts the Supportive Display Container with an open top on the inner structure and having a cushion with decorative items pushed into the cushion.
Figure 24:
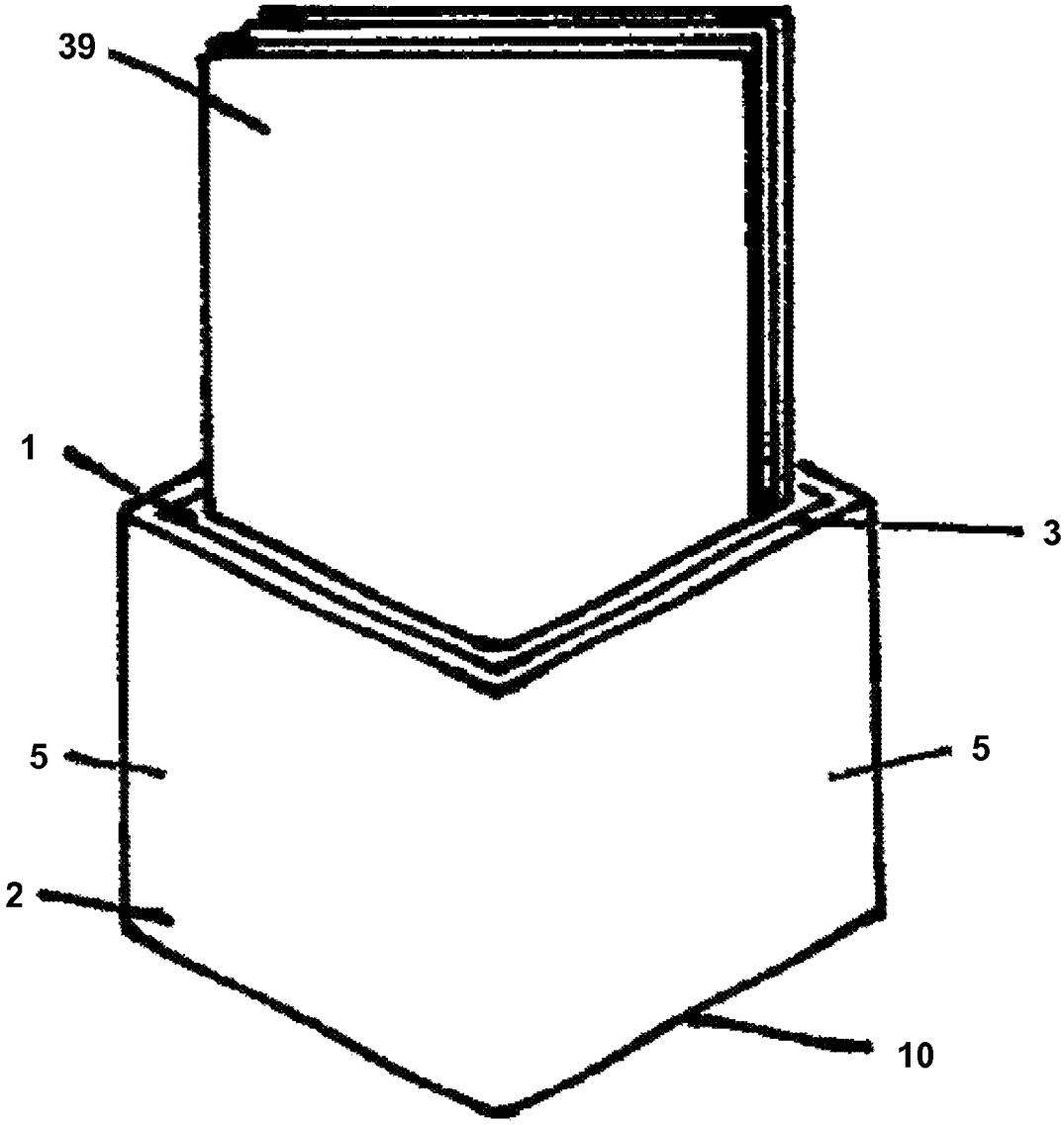
FIG. 24 illustrates the Supportive Display Container with an open top serving as a holder for business cards.
Figure 25:
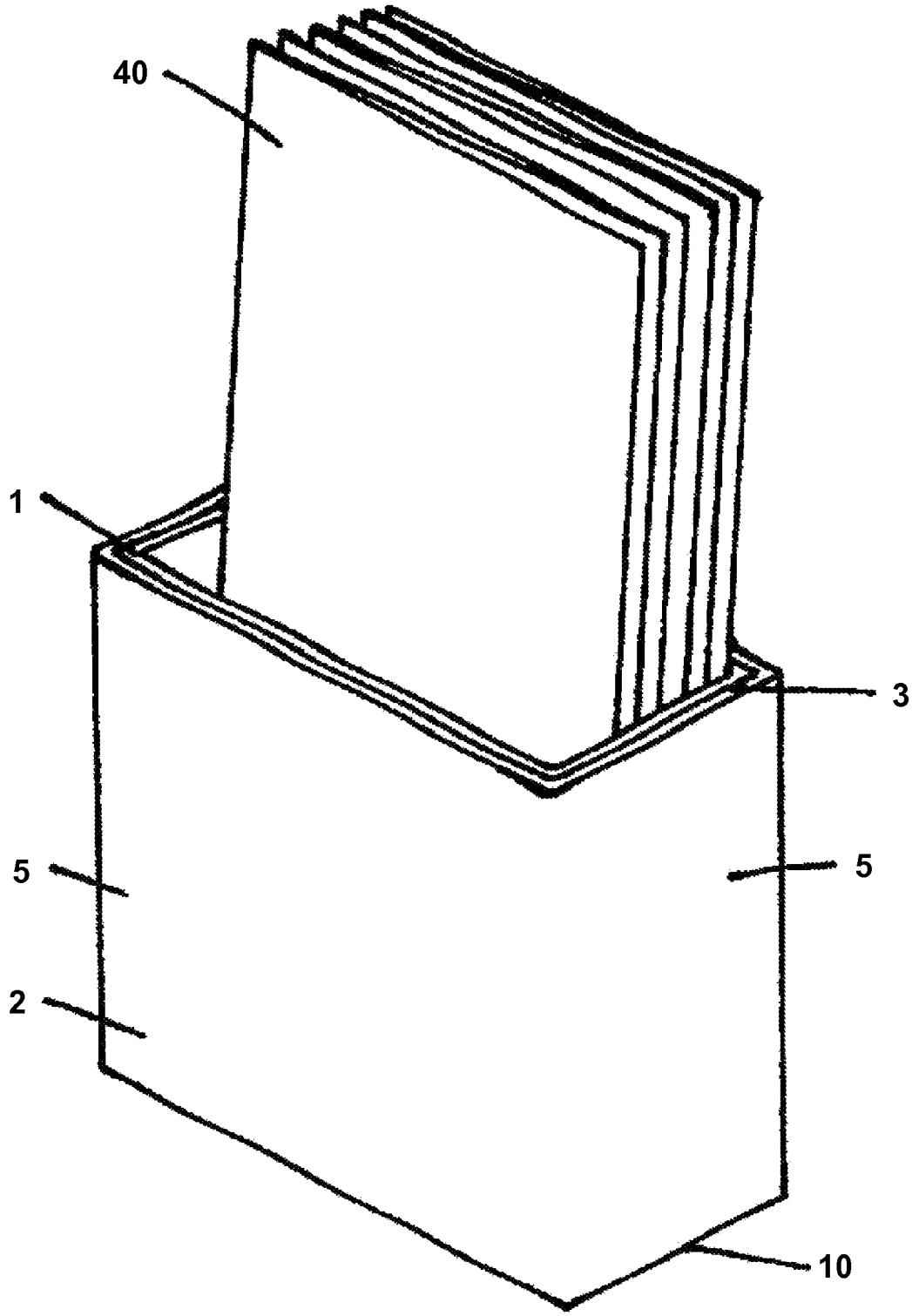
FIG. 25 portrays the Supportive Display Container with an open top being utilized to retain brochures.
Figure 26:
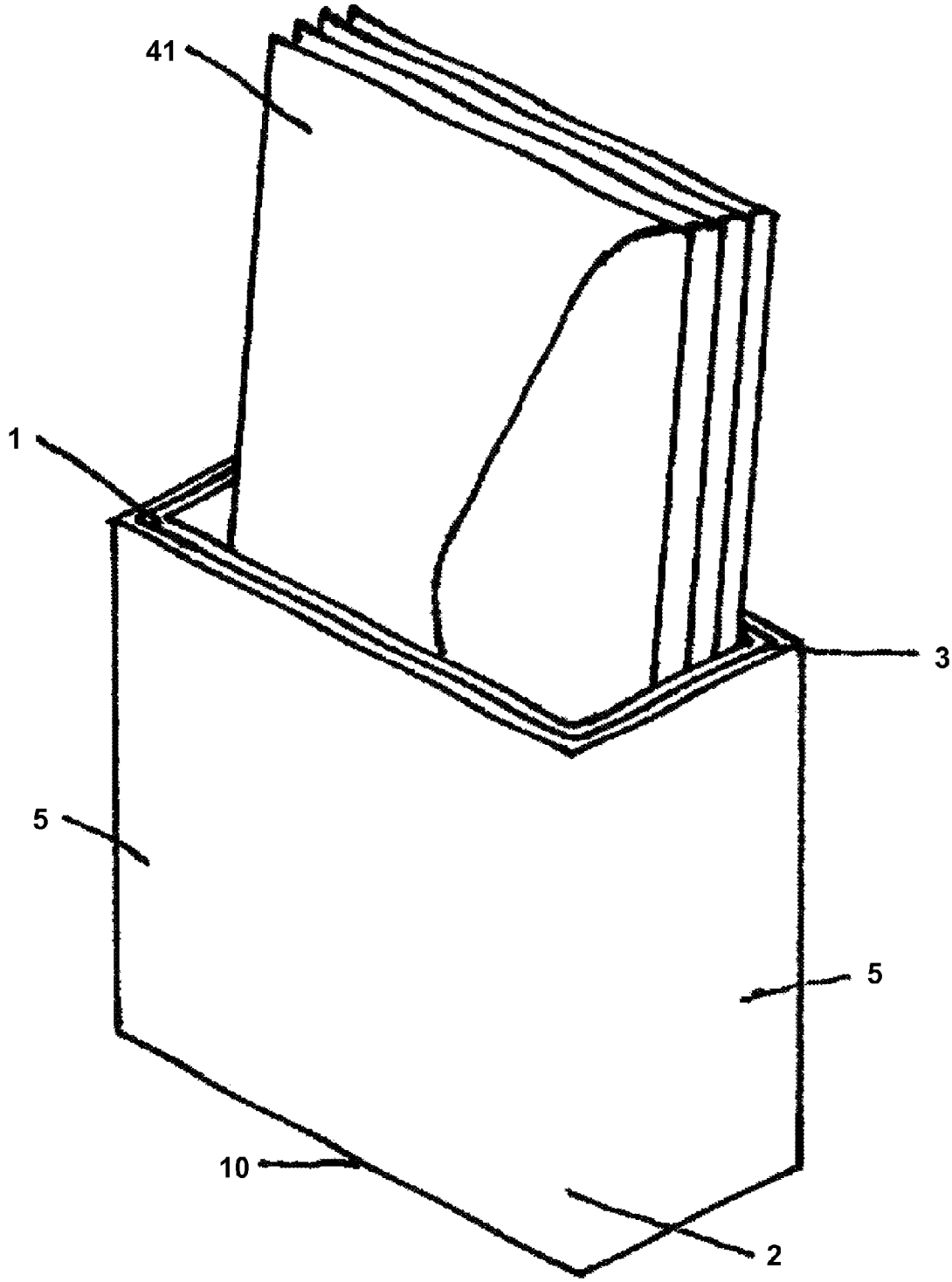
FIG. 26 demonstrates the Supportive Display Container with an open top being used to hold envelopes.
Figure 27:
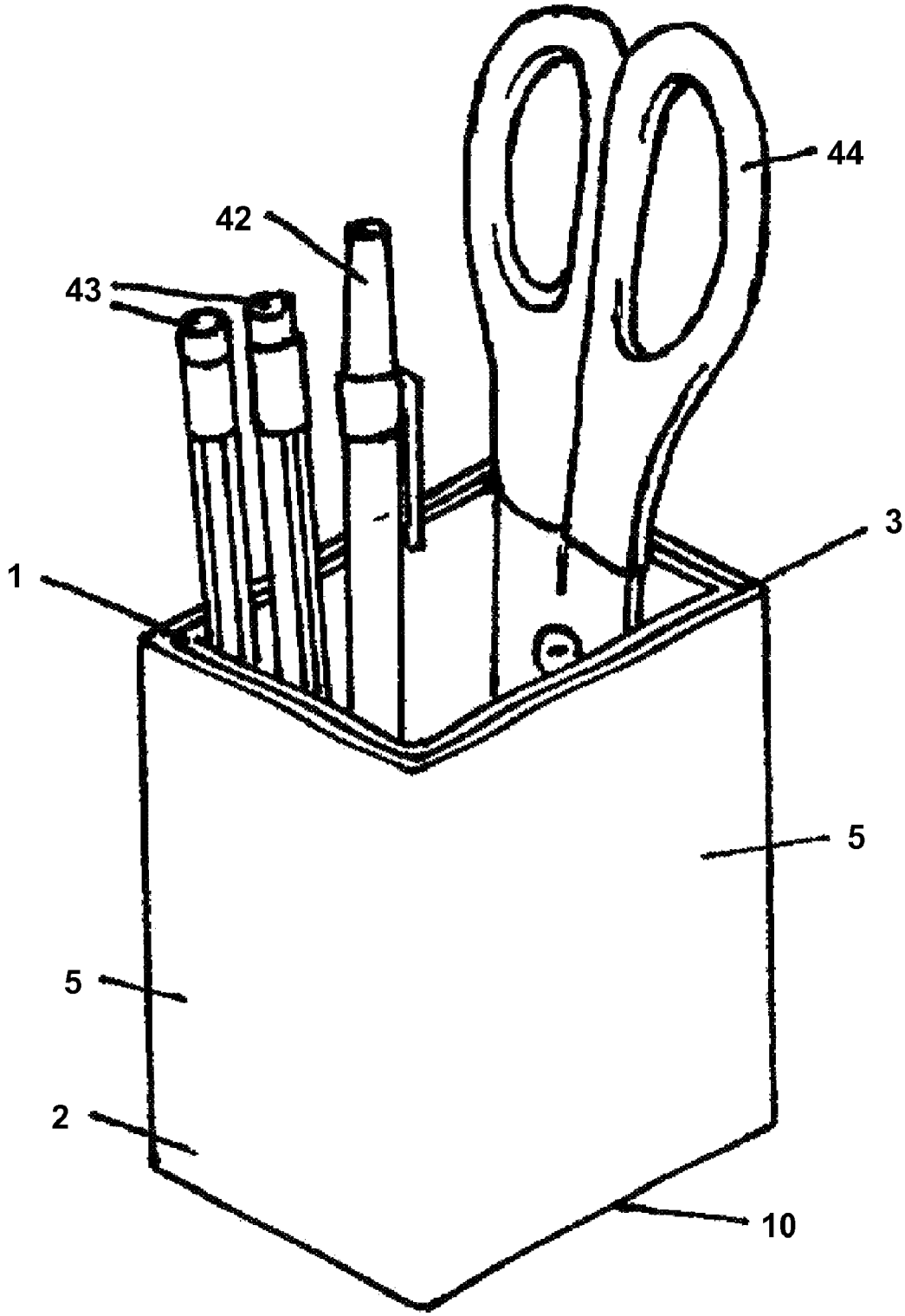
FIG. 27 shows the Supportive Display Container with an open top serving as a container for pens, pencils, and scissors.
Figure 28:
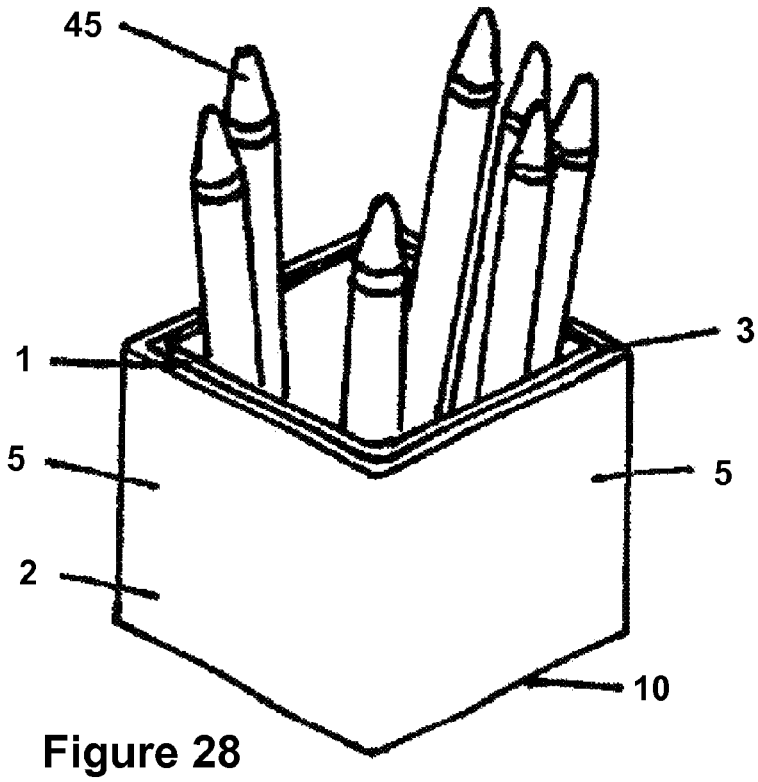
FIG. 28 depicts the Supportive Display Container with an open top containing crayons.
Figure 29:
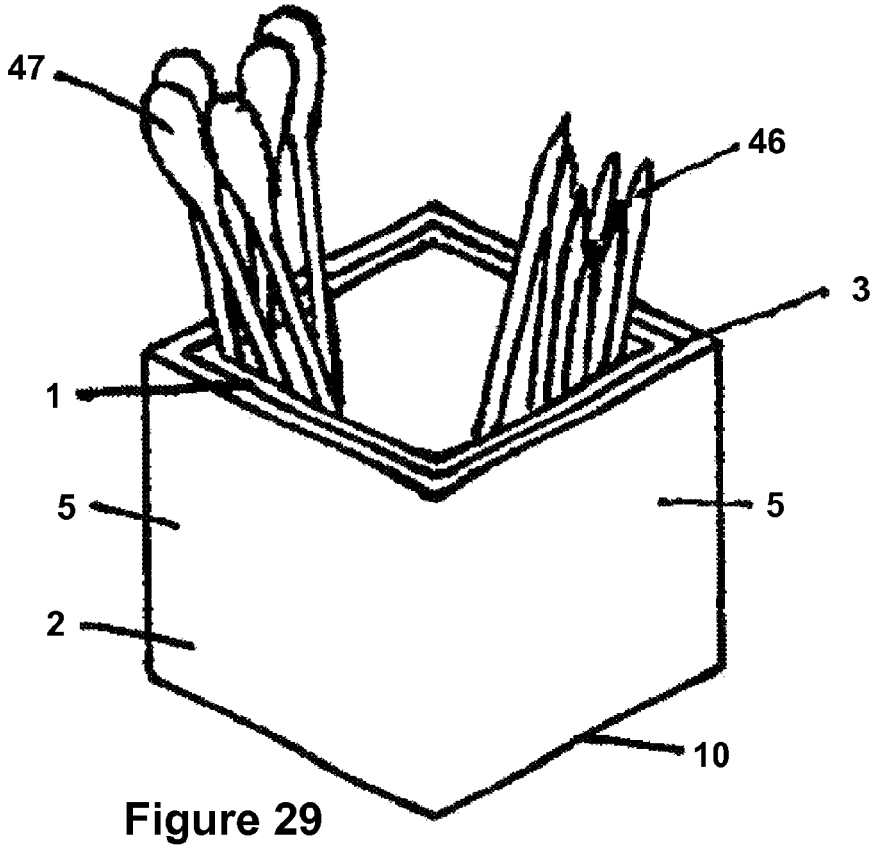
FIG. 29 illustrates the Supportive Display Container with an open top holding toothpicks and cotton swabs.
Figure 30:
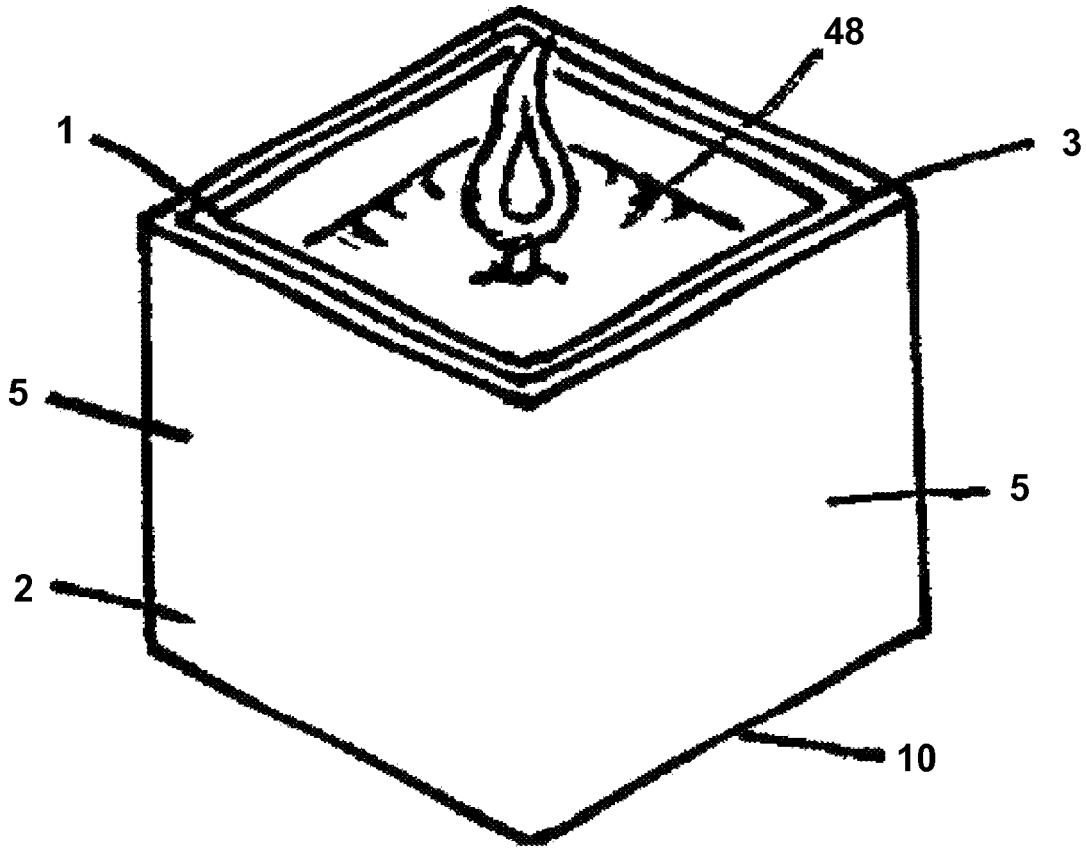
FIG. 30 portrays a candle inserted into the Supportive Display Container with an open top.
Figure 31:
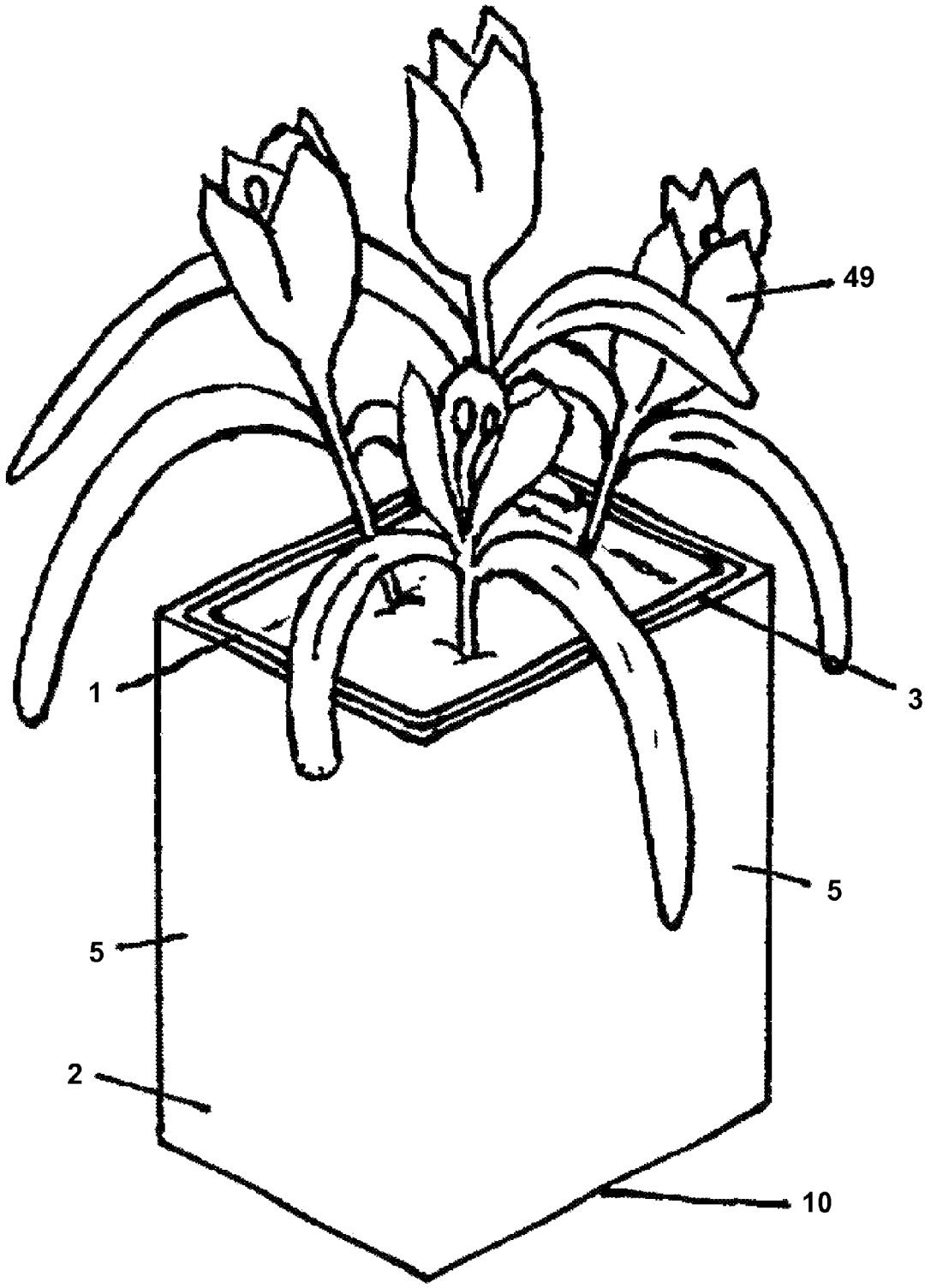
FIG. 31 demonstrates the use of the Supportive Display Container with an open top to hold plants.

And, as shown in FIGS. 20 and 21, the Supportive Display Container can be inverted and used to support the display end of an electronic apparatus 34, especially an amateur or "ham"

radio, in order to facilitate viewing by an operator and to reduce the fatigue that can be produced by the operator's having to bend to observe the display.

Finally, the use of the Supportive Display Container as an actual container, when the inner structure 1 has an open top 8, is illustrated in FIGS. 22 through 31 for an illustrative variety of contents. The Container holds a cushion 35 containing pins 36 and needles 37 in FIG. 22; a cushion 35 retaining decorative items 38 in FIG. 23; business cards 39 in FIG. 24; brochures 40 in FIG. 25; envelopes 41 in FIG. 26; a pen 42, pencils 43, and scissors 44 in FIG. 27; crayons 45 in FIG. 28; toothpicks 46 and cotton swabs 47 in FIG. 29; a candle 48 in FIG. 30; and plants 49 in FIG. 31.

I claim:

1. A display container, comprising: a unitary inner structure having at least one wall, a bottom, an open top having a flange extending outwardly from said open top, and an interior, said inner structure thereby defining an open storage receptacle; an outer structure having an open top, at least one wall, and a bottom, and wherein said inner structure flange is configured to abut said outer structure top to provide a stop for said inner structure relative to said outer structure, and wherein the dimensions of said inner structure and said outer structure are such that when said inner structure is placed within said outer structure, a gap is formed between at least one wall of said inner structure and at least one wall of said outer structure, said gap containing an insert, and wherein said gap is of such a dimension that when said insert is inserted within said gap, a compressive load is placed on said insert by said inner structure and said outer structure such that said inner structure and said outer structure are restricted from slipping apart, and wherein at least a portion of said at least one wall of said outer structure is transparent to permit viewing of said insert.

2. The display container of claim 1, wherein said receptacle removably contains a stored item.

3. The display container of claim 2 wherein said stored item defines at least one item of the following group of items comprising a card, a card holder, a pin cushion, a pin, a needle, a decorative item display cushion, a flag, a brochure, a business card, an envelope, a pen, a pencil, scissors, a crayon, a toothpick, a swab, a candle, and a plant.

4. The display container of claim 1, wherein said insert includes a predetermined image displayed thereon, and wherein said insert is positioned in said gap such that said predetermined image is viewable through said transparent portion of said at least one wall of said outer structure.

5. The display container of claim 1, wherein two walls of said inner structure meet at an angle and form a connecting region that is rounded.

6. The display container of claim 1, wherein said container defines a substantially open cubic shaped container.

7. The display container of claim 1, wherein said outer structure defines a substantially transparent outer structure.

8. A display container, comprising: a unitary inner structure having at least one wall, a bottom, an open top having a member extending outwardly from said open top, and an interior, said inner structure thereby defining an open storage receptacle; an outer structure having an open top, at least one wall, and a bottom, and wherein the dimensions of said inner structure and said outer structure are such that when said inner structure is placed within said outer structure and said inner structure member abuts said outer structure top, a gap is formed between at least one wall of said inner structure and at least one wall of said outer structure, said gap holding an insert, and wherein said gap is of such a dimension that with said insert inserted within said gap, a compressive load is placed on said insert by said inner structure and said outer structure such that said inner structure and said outer structure are restricted from slipping apart, and wherein at least a portion of said at least one wall of said outer structure is transparent to permit viewing of said insert.

9. The display container of claim 8, wherein said receptacle removably contains a stored item.

10. The display container of claim 9 wherein said stored item defines at least one item of the following group of items comprising a card, a card holder, a pin cushion, a pin, a needle, a decorative item display cushion, a flag, a brochure, a business card, an envelope, a pen, a pencil, scissors, a crayon, a toothpick, a swab, a candle, and a plant.

11. The display container of claim 8, wherein said member defines a flange extending outwardly from said open top, and wherein said inner structure flange is configured to abut said outer structure top to provide a stop for said inner structure relative to said outer structure.

12. The display container of claim 8, wherein two walls of said inner structure meet at an angle and form a connecting region that is rounded.

13. The display container of claim 8, wherein said container defines a substantially open cubic shaped container.

14. The display container of claim 8, wherein said outer structure defines a substantially transparent outer structure.

15. A display container, comprising: a unitary inner structure having at least one wall, a bottom, an open top having a member extending outwardly from said open top, and an interior, said inner structure thereby defining an open storage receptacle and removably containing a non-liquid stored item; an outer structure having an open top, at least one wall, and a bottom, and wherein the dimensions of said inner structure and said outer structure are such that when said inner structure is placed within said outer structure, and said inner structure member abuts said outer structure top a gap is formed between at least one wall of said inner structure and at least one wall of said outer structure, said gap containing an insert, and wherein said gap is of such a dimension that when said insert is inserted within said gap, a compressive load is placed on said insert by said inner structure and said outer structure such that said inner structure and said outer structure are restricted from slipping apart, and wherein at least a portion of said at least one wall of said outer structure is transparent to permit viewing of said insert.

16. The display container of claim 15 wherein said stored item defines at least one item of the following group of items comprising a card, a card holder, a pin cushion, a pin, a needle, a decorative item display cushion, a flag, a brochure, a business card, an envelope, a pen, a pencil, scissors, a crayon, a toothpick, a swab, a candle, and a plant.

17. The display container of claim 15, wherein said insert includes a predetermined image displayed thereon, and wherein said insert is positioned in said gap such that said predetermined image is viewable through said transparent portion of said at least one wall of said outer structure.

18. The display container of claim 15, wherein said member defines a flange extending outwardly from said open top, and wherein said inner structure flange is configured to abut said outer structure top to provide a stop for said inner structure relative to said outer structure.

19. The display container of claim 15, wherein said container defines a substantially open cubic shaped container, and wherein at least two walls of said inner structure meet at an angle and form a connecting region that is rounded.

20. The display container of claim 15, wherein said outer structure defines a substantially transparent outer structure.

* * * * *